US008567366B2

(12) United States Patent
Reese et al.

(10) Patent No.: US 8,567,366 B2
(45) Date of Patent: Oct. 29, 2013

(54) ENGINE MANIFOLD WITH MODULAR RUNNERS

(75) Inventors: Brian Reese, Collierville, TN (US); Tim Collins, Oxford, MI (US); Donald Carbone, Troy, MI (US)

(73) Assignee: Competition Cams, Inc., Memphis, TN (US)

( * ) Notice: Subject to any disclaimer, the term of this patent is extended or adjusted under 35 U.S.C. 154(b) by 607 days.

(21) Appl. No.: 12/458,286

(22) Filed: Jul. 7, 2009

(65) Prior Publication Data

US 2011/0005488 A1 Jan. 13, 2011

(51) Int. Cl.
*F02M 35/10* (2006.01)

(52) U.S. Cl.
USPC ..... 123/184.61; 123/184.21; 123/184.27

(58) Field of Classification Search
USPC ..... 123/41.01, 184.21, 41.55, 545, 546, 123/547, 184.24, 184.61, 184.47, 184.34, 123/184.42, 184.57
See application file for complete search history.

(56) References Cited

U.S. PATENT DOCUMENTS

| | | | | |
|---|---|---|---|---|
| 3,831,566 | A | 8/1974 | Thomas | |
| 4,440,120 | A * | 4/1984 | Butler | 123/184.34 |
| 5,003,933 | A * | 4/1991 | Rush et al. | 123/184.42 |
| 5,094,194 | A | 3/1992 | Rush, II et al. | |
| 5,273,010 | A | 12/1993 | Elder | |
| 5,636,605 | A * | 6/1997 | Nomizo et al. | 123/184.61 |
| 6,092,498 | A * | 7/2000 | Lohr et al. | 123/90.38 |
| 6,161,513 | A * | 12/2000 | Lohr et al. | 123/184.34 |
| 6,234,131 | B1 * | 5/2001 | Brassell et al. | 123/184.21 |
| 6,679,215 | B2 | 1/2004 | Benson et al. | |
| 7,021,263 | B1 * | 4/2006 | Agnew et al. | 123/184.47 |
| 7,086,365 | B1 * | 8/2006 | Teeter | 123/184.21 |
| 2004/0194750 | A1 * | 10/2004 | Tanikawa et al. | 123/184.42 |
| 2005/0279310 | A1 * | 12/2005 | Kondo et al. | 123/184.21 |
| 2006/0060163 | A1 * | 3/2006 | Vanderveen et al. | 123/184.42 |

OTHER PUBLICATIONS

US 2,279,224, 07/1981, Szabo et al. (withdrawn)

* cited by examiner

*Primary Examiner* — Noah Kamen
*Assistant Examiner* — Long T Tran
(74) *Attorney, Agent, or Firm* — Arent Fox LLP

(57) ABSTRACT

An intake manifold assembly for an internal combustion engine that has a modular construction and includes a base member, a runner, and a shell, wherein the base member removably attaches to the engine, and the runner and the shell each separately and independently removably attach to the base member. In another aspect, the assembly further includes a fastener for attaching the runner to the base member, wherein the shell is formed so as to retain the fastener between the shell and the base member when the shell is attached to the base member. In another aspect, the assembly further includes a bumper affixed to a surface of the base member, wherein the bumper abuts a surface of the internal combustion engine. In another aspect, the base member includes a sealing ridge that mates with a sealing groove provided on the shell.

29 Claims, 32 Drawing Sheets

Raised Rectangular Port

Rectangular Port

Cathedral Port 10
20
40
600
600
600

ENGINE MANIFOLD WITH MODULAR RUNNERS

BACKGROUND OF THE INVENTION

1. Field of the Invention

Aspects of the present invention relate to an intake manifold for an internal combustion engine and, more particularly, to a manifold having interchangeable parts capable of disassembly and reassembly.

2. Background of the Technology

Internal combustion engines generally include an intake manifold. The intake manifold directs air or a fuel and air mixture into the cylinders of the engines where the fuel and air mixture is combusted, releasing mechanical energy to power the engine.

Intake manifolds have been traditionally made by either casting metals into a single component or by forming plastics or polymers into several different pieces that are then permanently bonded together, by, for example, friction welding. Subsequent attempts to disassemble either of the traditional types of manifolds results in severe damage to the intake manifold. Therefore, these construction types have precluded the intake manifold from being tuned to alter individual engine performance, or allowing clearing or removal of excess metal or other material, for example, without completely removing and discarding the current intake manifold and obtaining and installing a new intake manifold. Such replacement is both costly and wasteful. Additionally, removal of the traditional intake manifold destroys the seal between the intake manifold and the engine, exposing internal components of the engine to external debris and contamination. Thus, in order to tune engine performance by means of the intake manifold, e.g., adjusting runner length, a user must essentially purchase an entirely new intake manifold part and subject the engine to potential damage from external contamination, among other things.

Prior art patents disclosing multipiece intake manifolds capable of being disassembled are known, such as U.S. Pat. No. 3,831,566 issued to Thomas and U.S. Pat. No. 4,279,224 issued to Szabo, et al., the entirety of each of which is hereby incorporated by reference. However, among other things, none of these patents provides for a manifold comprising easily removed and replaced components having different characteristics, such as air inlet size and internal runner shape, to alter engine performance. U.S. Pat. No. 7,021,263 issued to Agnew et al., the entirety of which is hereby incorporated by reference, provides an improved intake manifold for an internal combustion engine that permits disassembly, replacement or substitution, and reassembly without detriment to the individual intake manifold components. The Agnew manifold has a multiple piece construction comprising, for example, a lower base member, a center runner section, and an upper shell, wherein the upper shell and center runner section fixably attach to the lower base member in such a way that the components can later be disassembled. The center runner section is formed with runner cavities of different shapes that work with the upper shell and the lower shell to change the airflow within the intake manifold and, hence, the way in which the air is delivered to the engine. However, among other things, Agnew does not provide for interchangeable individual runners that function independently from the manifold shell, wherein the runners can be easily removed and replaced without requiring an associated removal and replacement of an upper shell and/or a lower shell in order to alter the air intake qualities, and hence the performance, of an internal combustion engine.

SUMMARY OF THE INVENTION

Aspects of the present invention provide for an intake manifold for an internal combustion engine that permits efficient disassembly, replacement and/or substitution, and reassembly of an intake manifold, in which variably dimensioned independent runners are easily removed and replaced to alter engine performance, for example, without the requirement of replacing an upper shell and/or a lower shell due to permanently formed or attached flow pathways therein. As a result, the intake manifold in accordance with aspects of the present invention may be disassembled and assembled with a new runner configuration without causing damage to the component parts of the intake manifold. Similarly, the intake manifold may be disassembled and assembled with a new shell configuration, permitting a larger (or smaller) and/or different length air inlet, for example, and thus permitting transmittal of different volume(s) of air through the intake manifold and/or transmittal of air with different flow characteristics.

The modularity and ease of assembly/disassembly of the intake manifold allows for the efficient mixing and matching of component parts, e.g., the shell, base member, and/or individual runners, to achieve targeted performance goals for an engine at significant advantage, including at lower cost and with less waste. The ability to simply unfasten the shell and remove, replace and/or exchange one or more of the individual runners with runners of different lengths and/or shapes, for example, facilitates the efficient fine tuning of a particular engine's performance characteristics. For example, different runners may be used with the same or different base members to serve different engine displacements and revolution per minute (rpm) ranges. The ability to disassemble the shell from the base member to access and/or exchange the runners, and then simply reassemble the intake manifold, eliminates the complete replacement and/or welding, gluing, and other cumbersome requirements typical with most intake manifold repairs and/or modifications.

Furthermore, the modular construction of the intake manifold permits the shell and/or the runners to be changed, for example, without having to disassemble the base member from the engine. Therefore, the seals between the intake manifold and the cylinder heads can remain intact. Accordingly, there is less risk of debris entering into the engine and, therefore, less risk of internal engine damage while removing and/or replacing various components of the intake manifold.

In some variations, constructing the various components of the intake manifold from an advanced polymer material, for example, provides the added benefits of lighter weight, increased strength and improved heat dissipating characteristics. The injection molded design of the various components, among other things, also allows perfect bolt-on fitment of various factory accessories without modification or clearance concerns, including, for example, integrated nitrous bungs and provisions for various Positive Crankcase Ventilation (PCV) features, vacuum nipples, fuel rails, and throttle body linkages.

Additional advantages and novel features of aspects of the invention will be set forth in part in the description that follows, and in part will become more apparent to those skilled in the art upon examination of the following or upon learning by practice of the invention.

DETAILED DESCRIPTION

Figure 1:
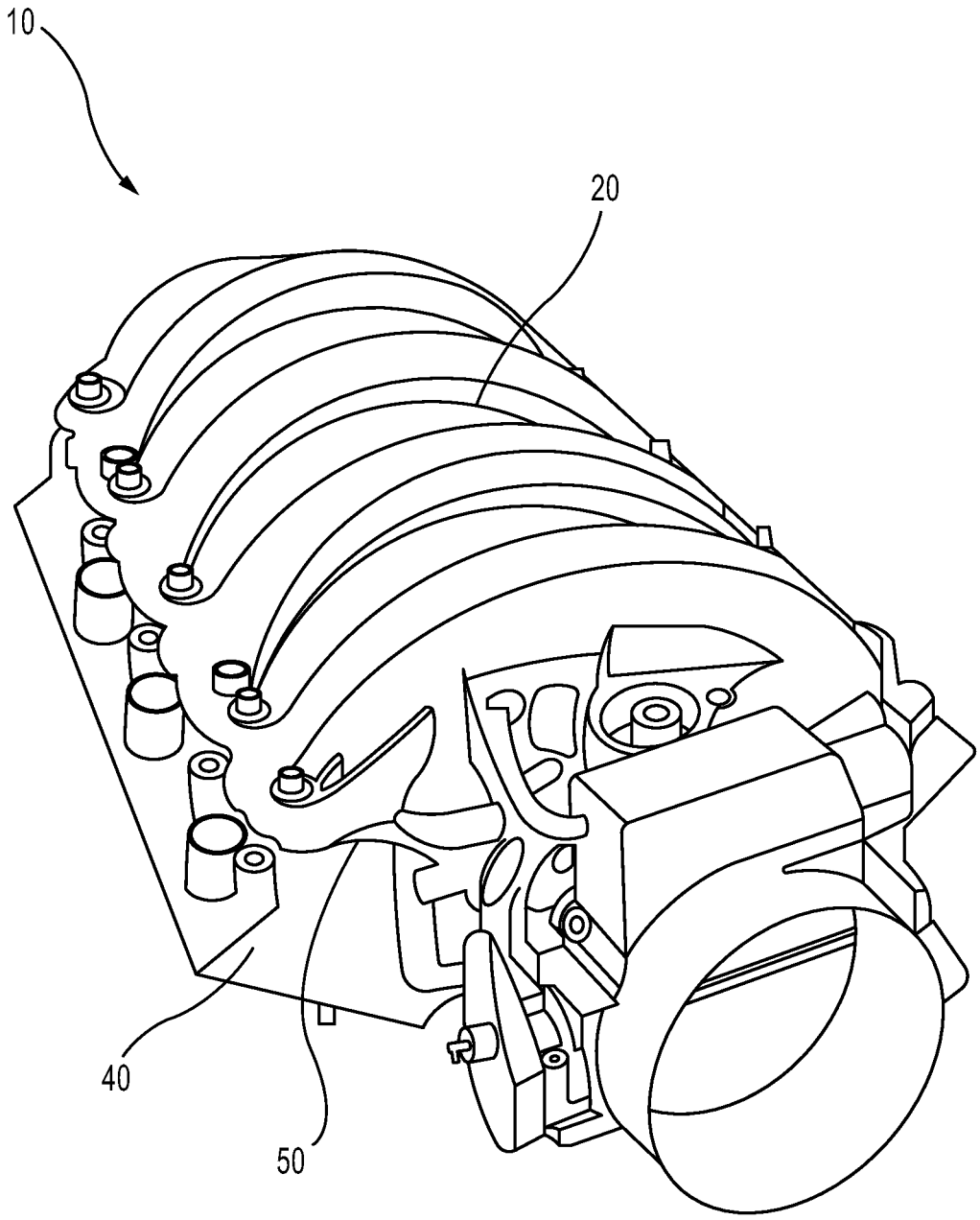
FIG. 1 shows an exemplary intake manifold assembly, in accordance with aspects of the present invention.

FIG. 1 shows an exemplary intake manifold assembly 10 for an eight-cylinder internal combustion engine in accordance with aspects of the present invention. However, it is understood that aspects of the invention are applicable to an internal combustion engine having any number of cylinders. The intake manifold assembly 10 has a shell 20, individual runners 30 (see FIG. 2), and a base member 40. As shown in FIG. 1, the shell 20 is the upper component and the base member 40 is the lower component of the intake manifold assembly 10. The intake manifold assembly 10, or components thereof, may be constructed from a state-of-the-art polymer material for cooler airflow operations, compared to an aluminum manifold, for example, which aluminum may tend to act as a heat-sink, reducing an engine's power. The shell 20 secures to a mating surface 50 of base member 40 with the individual runners 30 enclosed between the shell 20 and the base member 40.

Figure 2:
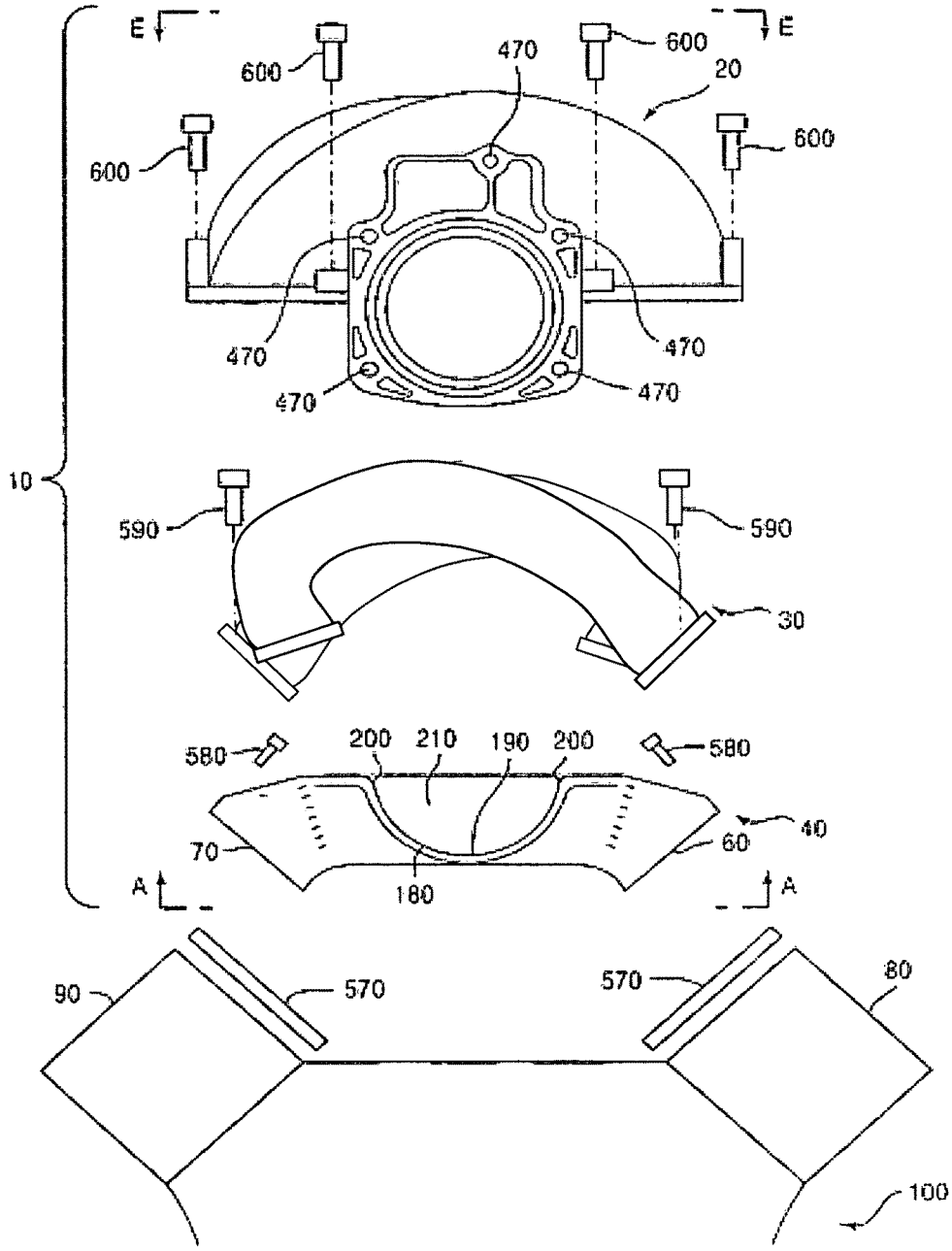
FIG. 2 shows an exploded view of an intake manifold assembly, in accordance with aspects of the present invention FIG. 3 corresponds to view A-A of FIG. 2 and is a bottom view of an intake manifold assembly, in accordance with aspects of the present invention.

FIG. 2 is an exploded view of an intake manifold in accordance with aspects of the present invention. One individual runner 30 may be secured to the base member 40 for each cylinder of the engine 100. For example, an eight cylinder engine may have eight individual runners 30 secured to the base member 40. Each runner 30 may be designed to be very similar or essentially identical, for example, or each runner 30 may be individually tuned for each cylinder of a particular engine 100. The individual runners 30 may be formed to be of varying dimensions, including different shapes and lengths, for example, and limited only by the dimensions of the plenum chamber formed between the shell 20 and the lower base 40 into which the runners 30 are fitted. For example, a set of short runners may be installed for higher horsepower applications and easily exchanged for a set of longer runners for low-end torque applications.

As shown in FIG. 2, the base member 40 may include right 60 and left 70 mating faces that abut mating surfaces on right 80 and left 90 cylinder heads of an engine 100. A semicircular flange 180 having an upper surface 190 and rounded surfaces 200 may be formed at the front of base member 40 to create a semicircular front opening 210.

Figure 3:
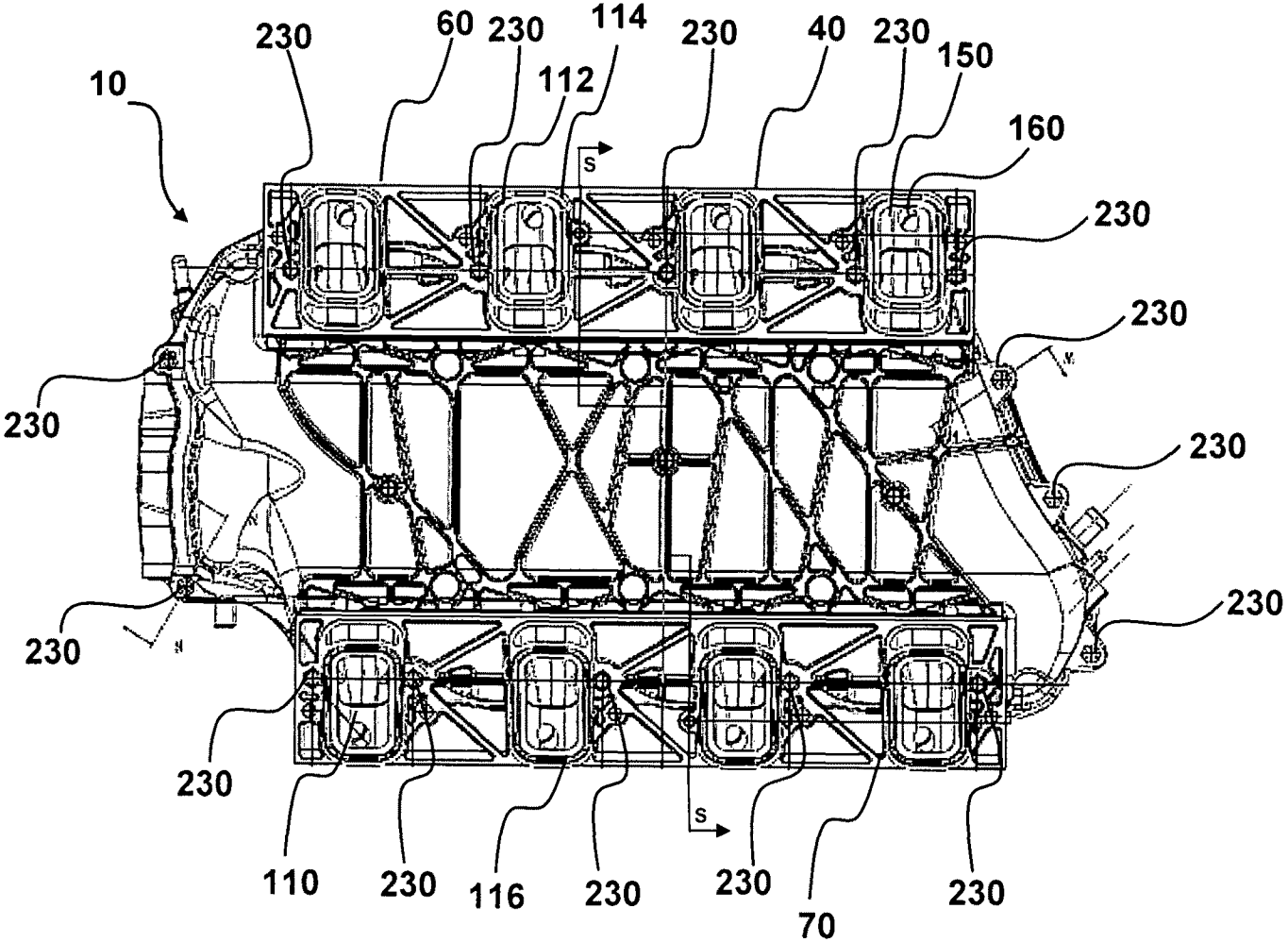
Figure 4:
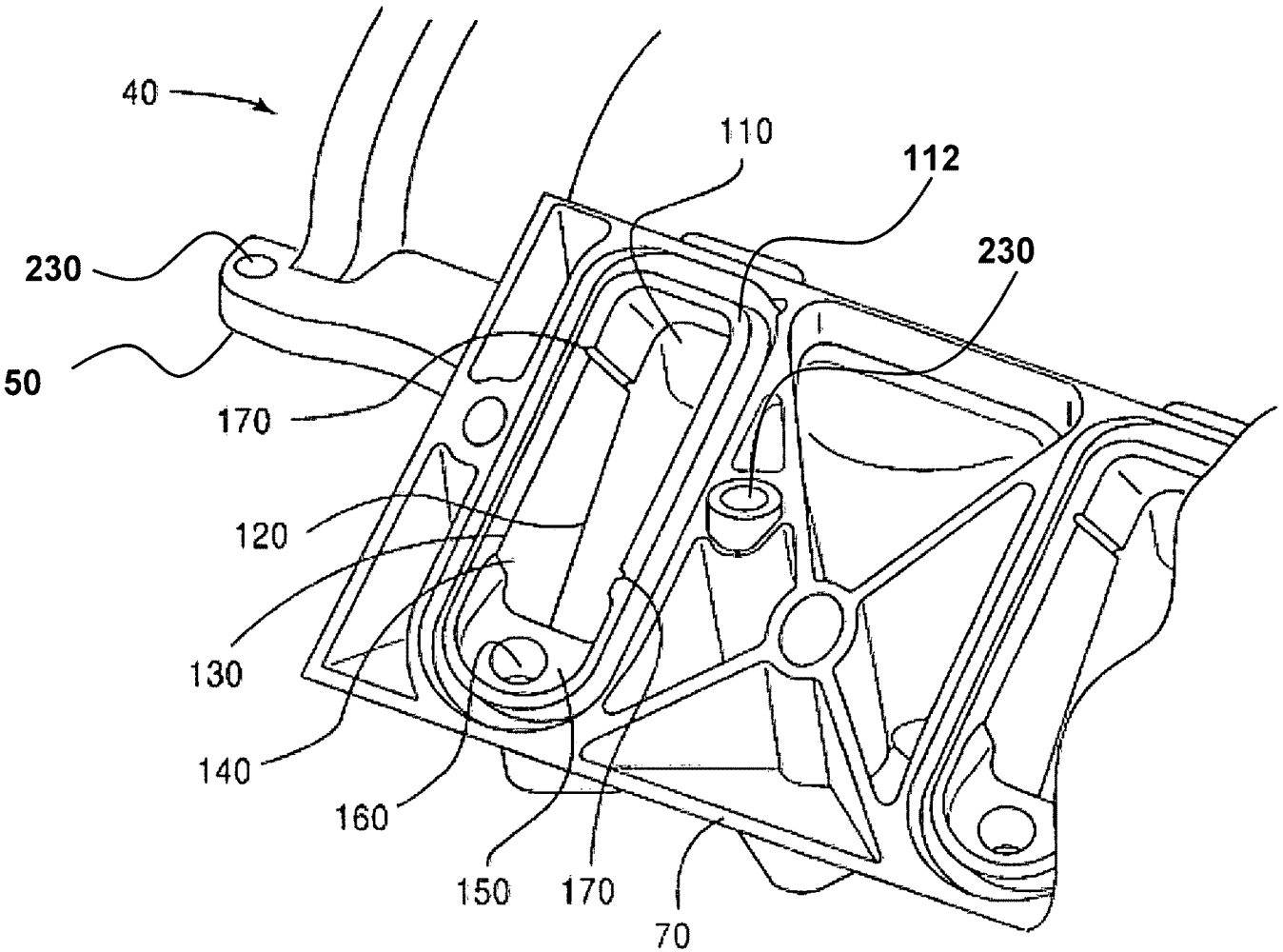
FIG. 4 shows an exemplary air outlet, in accordance with aspects of the present invention.

FIG. 3 corresponds to view A-A of FIG. 2 and is a bottom view of the intake manifold assembly 10. As shown in FIG. 3, air outlets 110 are provided within the base member 40. The air outlets 110 are formed to correspond to inlet ports (not shown) provided in the cylinder heads 80 and 90. A raised pad 112 and a seal groove 114 may be provided around the perimeter of the air outlet 110. As shown in FIG. 3 with respect to the right mating face 70 of the base member 40, a rope style o-ring type seal 116, for example, may be press fit into the seal groove 114 surrounding the raised pad 112 in order to provide a sealed connection when the base member 40 is attached to the engine 100. As shown in FIGS. 3 and 4, a series of through-holes 230 may be provided from the mating surface 50 of the base member 40 that extend through the entire thickness of the base member 40.

Figure 5A:
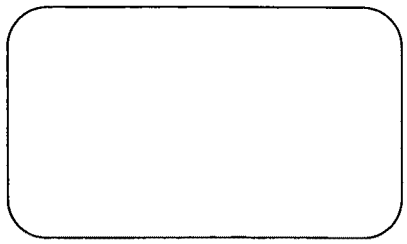
FIGS. 5A-5C show exemplary shapes for inlet ports for different engines, in accordance with aspects of the present invention.
Figure 5B:
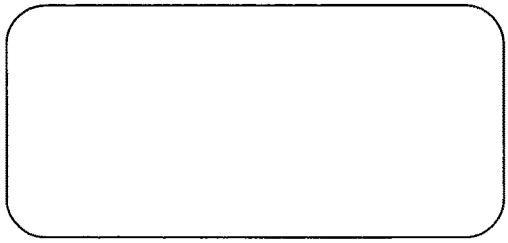
Figure 5C:
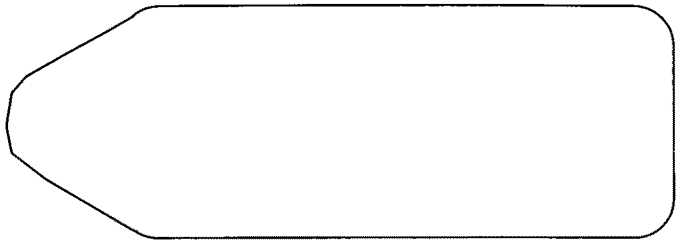

FIG. 4 shows an exemplary air outlet 110 in accordance with aspects of the present invention. The air outlet 110 with raised pad 112 may have an upper edge 120 relative to a lower edge 130, as well as an interior surface 140 extending from the upper edge 120 to the lower edge 130. The air outlets 110 are formed to correspond to the inlet ports (not shown) provided in the cylinder heads 80 and 90. As illustrated in FIGS. 5A-5C, for example, inlet ports may be shaped and sized differently for different engines. Accordingly, the base member 40 may be designed with air outlets 110 of varying shape, size and/or location to mate properly with a designated engine 100. Once the base member 40 is mounted onto the engine 100, the air outlets 110 mate with the inlet ports of cylinder heads 80 and 90 to form passages extending through the entire thickness of base member 40, allowing communication between the interior of the intake manifold 10 and the inlet ports of cylinder heads 80 and 90.

As shown in FIGS. 3 and 4, surfaces 150 may be provided within an outer periphery of the air outlets 110 near the outer periphery of the base member 40. An opening 160 may extend from each surface 150 through the entire thickness of the base member 40.

Referring to FIG. 4, a witness mark 170 may be formed into the interior surface 140 of the air outlets 110. The witness mark 170 may, among other things, allow removal of material from the interior surfaces 140 of the air outlets 110 in a practice referred to herein as "porting". The depth of the witness mark 170 defines the depth of material that may be safely removed by porting without the risk of damaging the seal between the intake manifold assembly 10 and the engine 100.

Figure 6:
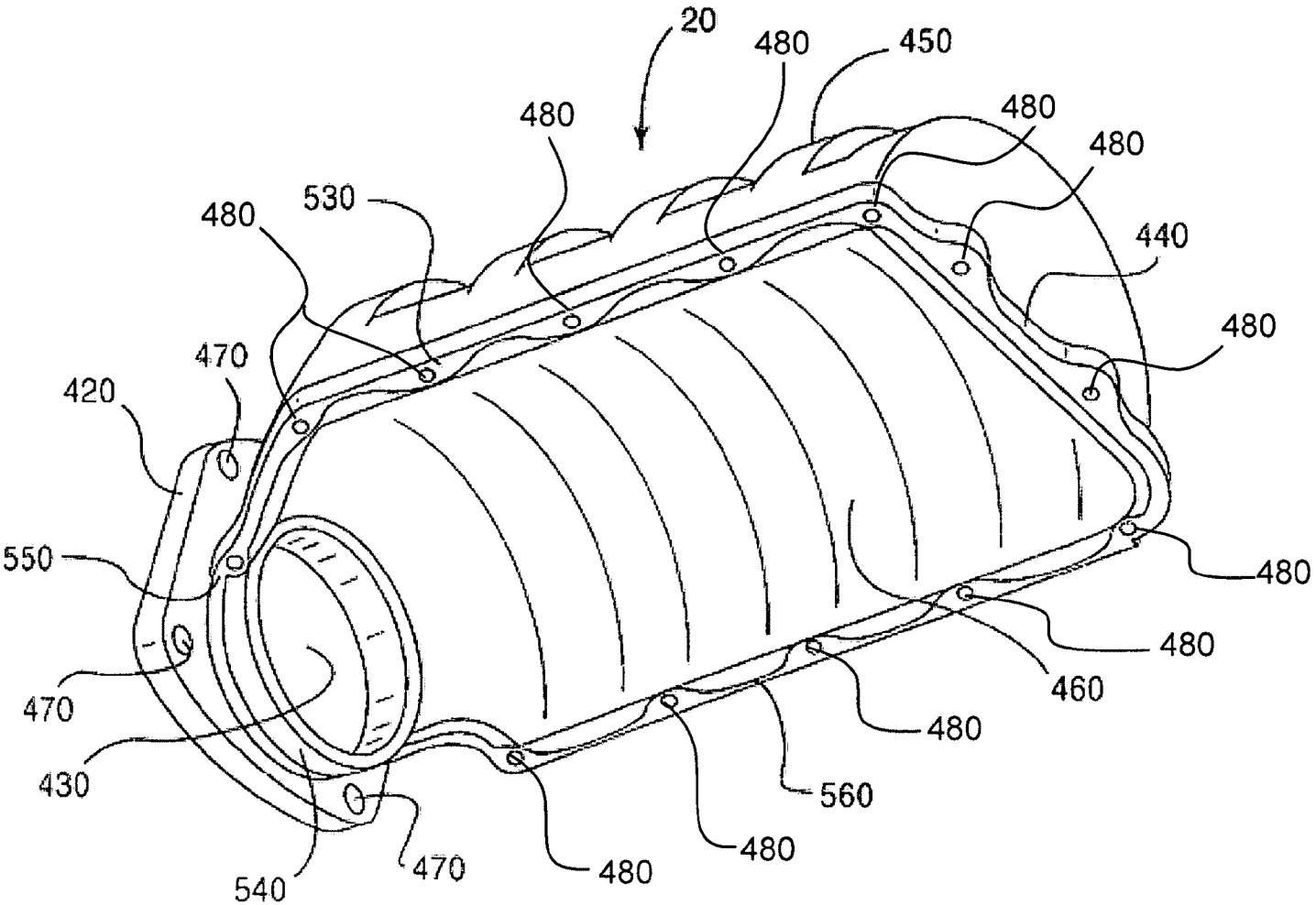
FIG. 6 is an isometric view of an exemplary shell for a modular intake manifold assembly, in accordance with aspects of the present invention.

FIG. 6 is an isometric view of the shell 20 that illustrates a continuous lower mating surface 530, comprised of a lower surface of the mating flange 440, a lower semicircular surface 540, and rounded surfaces 550.

The shell 20 may enclose the intake manifold assembly 10 from above, for example. The shell 20 may be formed as a single piece component, for example, manufactured by any number of well-known casting or molding techniques. As shown in FIG. 6, the shell 20 may comprise a throttle body mounting boss 420, an inlet 430, a peripheral mating flange 440, an upper portion 450, and an interior cavity 460. The inlet 430 communicates with the interior cavity 460 and may be circular in shape. However, the inlet 430, in accordance with aspects of the instant invention can be of any suitable shape. As illustrated in FIG. 6, a series of openings 470 may extend through the throttle body mounting boss 420 from a front face and accept heat staked inserts used to attach a throttle body or other fasteners to the shell 20. Similarly, the openings 470 may be threaded and accept bolts, for example, to attach a throttle body to the shell 20. A series of openings 480 extend through the mating flange 440 from an upper surface, as shown in FIG. 6. The upper portion 450 may comprise a series of contours that extend from an edge of the mating flange 440 to an opposing edge on the mating flange 440. The contours may be formed to efficiently accommodate the runners 30, while maintaining specified clearance parameters for an engine 100 within a specific engine compartment. A sealing ridge 560 may extend from a surface of the mating flange 440.

The components of the intake manifold assembly 10 may be assembled as follows. As shown in FIG. 2, the base member attaches to the engine 100 between the cylinder heads 80 and 90. The mating faces 60 and 70 may engage corresponding mating surfaces on the cylinder heads 80 and 90 with a series of gaskets 570 or other sealing mechanisms provided there between. When the base member 40 is properly positioned on the engine 100, openings 160 align with corresponding openings in the cylinder heads 80 and 90 of the engine 100. Securing features 580, such as bolts, may insert through the openings 160 and attach, e.g., screw into corresponding threaded opening(s), to the cylinder heads 80 and 90, creating a sealable interface of the mating faces 60 and 70, e.g., via the gaskets 570, and the mating surfaces of the cylinder heads 80 and 90. Further, as previously described, the air outlets 110 align with the corresponding inlet ports in the cylinder heads 80 and 90 of the engine 100, allowing communication between the interior of both the intake manifold 10 and the engine 100.

Figure 7:
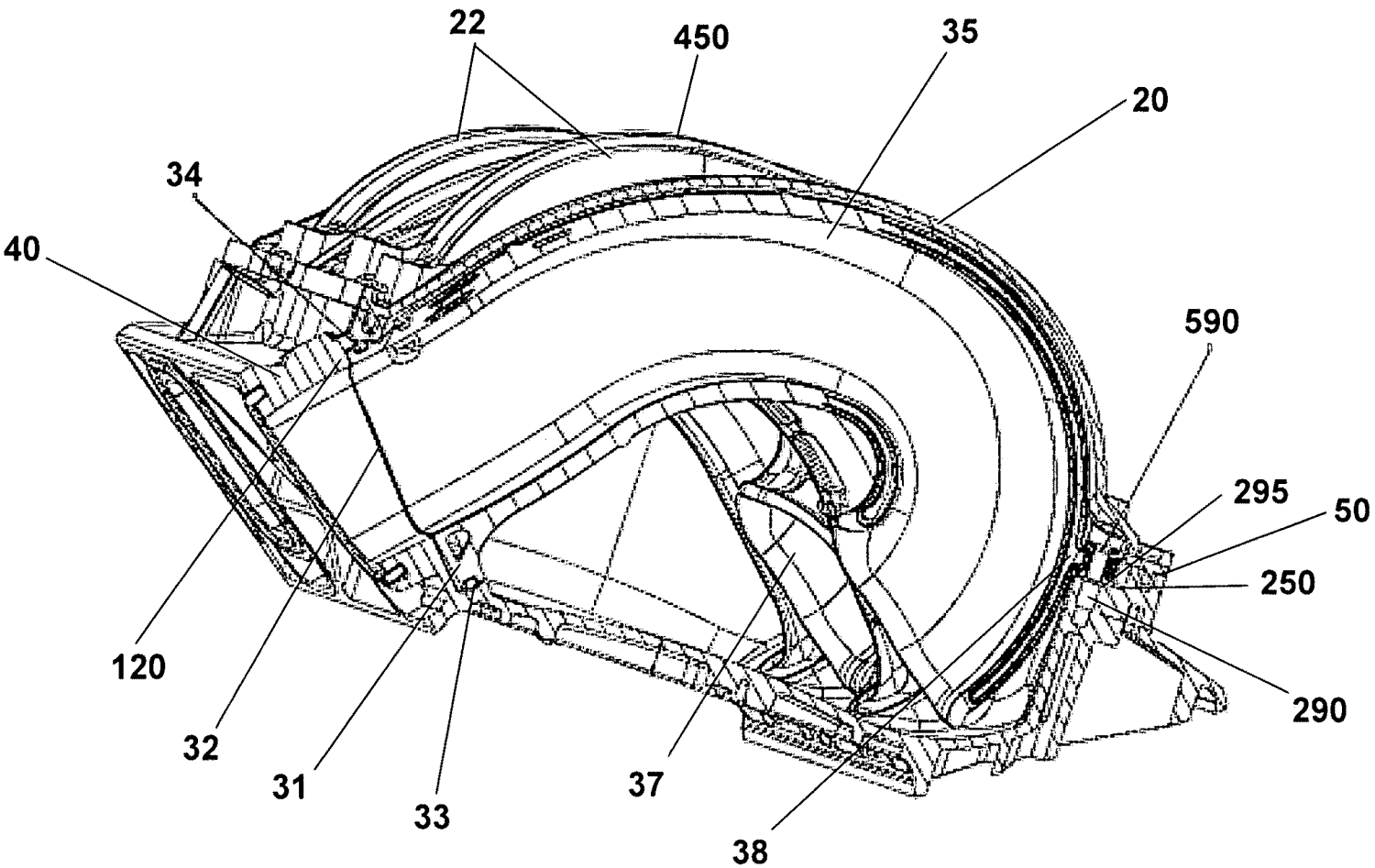
FIG. 7 is a cross-sectional view of an intake manifold assembly, in accordance with aspects of the present invention.

The individual runners 30 may then be inserted into and attached to the base member 40. FIG. 7 is a cross-sectional view of an intake manifold assembly 10 in accordance with aspects of the present invention. As shown in FIG. 7, each runner 30 may be formed with a flange section 31, a tube section 35, and a plenum section 37. The flange section 31 may be formed to mate with the edge 120 of the air outlet 110. The edge 120 may thus seat the runner 30 when an outlet 32 of the runner 30 is inserted into the air outlet 110. The flange portion 31 of the runner 30 has a peripheral groove 33 into which a runner tube seal 34, e.g., a rope style o-ring type seal, may be inserted to provide a seal between the outlet 32 of the runner 30 and the base member 40. An additional sealant, such as silicone gel, for example, may be applied to the flange portion 31 of the runner 30 prior to seating the outlet 32 of the runner 30 into the base member 40.

The tube section 35 may be formed in virtually limitless variations within the dimensions available to create variations in the air flow pattern, while maintaining a compact design. For example, the runner 30 may vary in length by increasing or decreasing the radius of curvature of the tube section 35. The runners 30 may be designed as shown in FIG. 7, with smooth contours, for example, to create more predictable air flow patterns without the associated pressure drops that occur in runners with more abrupt changes in shape and/or contour.

As shown in FIG. 7, bosses 290 may be provided on an interior surface 250 of the base member 40. Attendant features, such as threaded openings 295 may be formed on or used in connection with the bosses 290 and extend into the base member 40. A tube shell fastener 590, such as a bolt, may be used to attach the runner 30 to the base member 40, which may be by way of a protrusion 38 formed on an outer peripheral surface of the runner 30, for example. The tube shell fastener 590 may extend through the protrusion 38 and attach the runner 30 in place by aligning with the threaded openings 295 provided on the bosses 290 integral to the interior surface 250 of the base member 40. The tube shell fastener 590 may screw into the threaded openings 295, for example, to securely attach each runner 30 to the base member 40 in a designated location within the plenum chamber formed between the shell 20 and the base member 40.

As shown in FIG. 7, the shell 20 may be formed with contours 22 for further securing the runners 30 in position. Furthermore, the shell 20 may be formed to cover and clamp down on the top of the tube shell fastener 590 attaching the runners 30 to the base member 40. Thus, by attaching the shell 20 to the base member 40, the runners 30 may be secured in place and the tube shell fasteners 590 may be effectively trapped by the shell 20, preventing the tube shell fasteners 590 from working out of the threaded openings 295 and becoming a hazard to the operation of the engine, for example. Similarly, in the event that one forgets to secure a runner 30 in place by using a tube shell fastener 590, the runner 30 may be held in place by the contours 22 of upper surface 450 and the clamping effect of the shell 20 with the base member 40.

Figure 8:
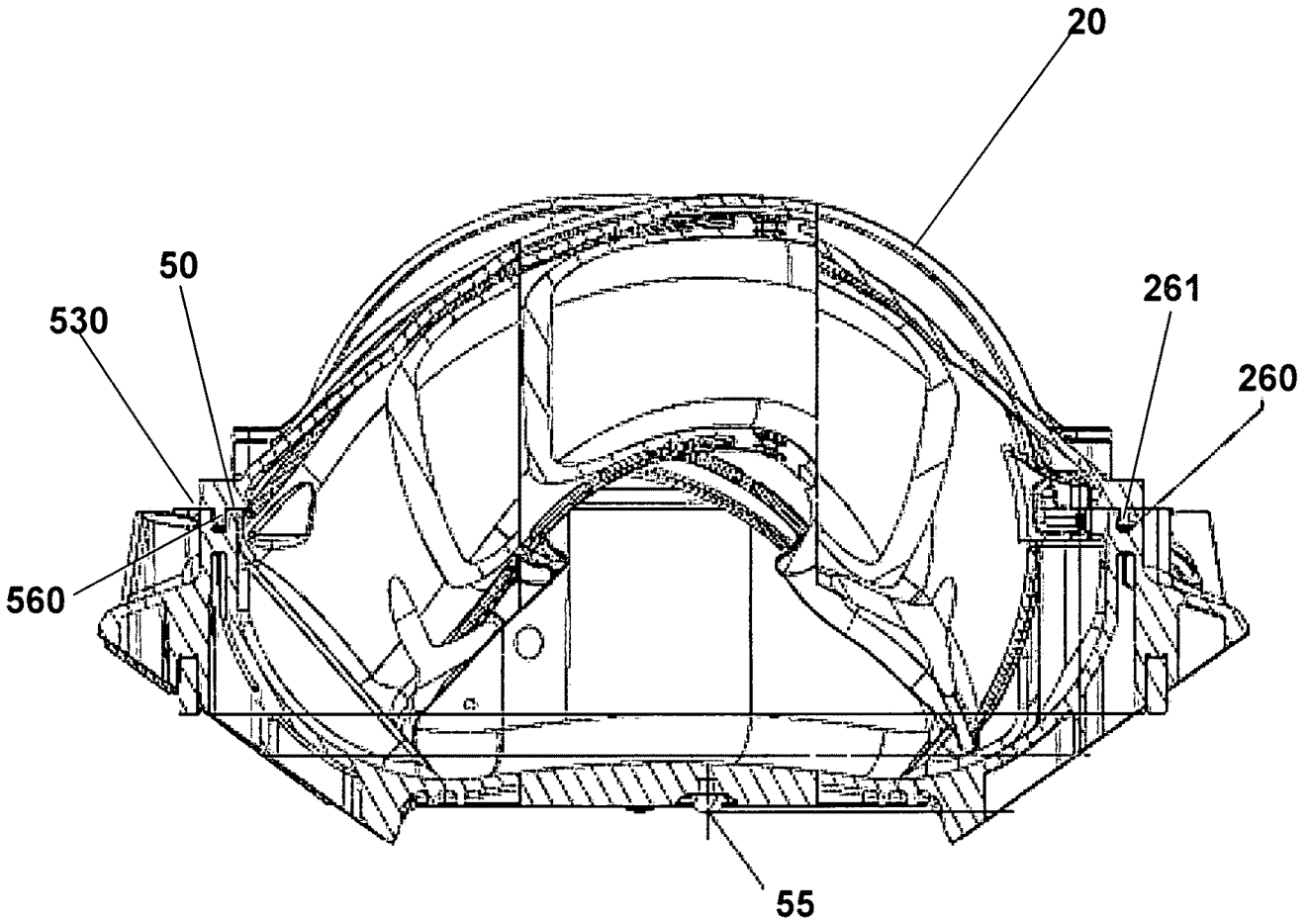
FIG. 8 corresponds to view S-S of FIG. 3 and is another cross-sectional view of the intake manifold assembly, in accordance with aspects of the present invention.

FIG. 8 corresponds to view S-S of FIG. 3 and is another cross-sectional view of the intake manifold assembly 10, in accordance with aspects of the present invention. The shell 20 may be attached to the base member 40, which may enclose the runners 30, for example. When properly oriented, the mating surface 530 of the shell 20 contacts the mating surface 50 of the base member 40. A sealing ridge 560 may be provided on the mating surface 530 of the shell 20, and a matching sealing groove 260 may be provided in the mating surface 50 of the base member 40. A rope style o-ring type seal 261, for example, may be provided in the sealing groove 260. As such, when the shell 20 is aligned over the base member 40, the sealing ridge 560 is forced into the sealing groove 260, pinching the o-ring seal 261 and creating a seal when the shell 20 is attached to the base member 40.

FIG. 8 also shows an exemplary bumper 55 applied to a lower surface of the base member 40. One or more bumpers 55 may be applied along the lower surface of base member 40. The bumpers 55, which may be self-adhesive, for example, compress against and are supported by the top of a valley cover of the engine 100. By using the valley cover as a stressed member, the plenum of the intake manifold assembly 10 may be enlarged by reducing the support structure necessary for the base member 40. The valley cover of the engine 100 may therefore provide the necessary structural support to the bottom of the intake manifold assembly 40.

Figure 9:
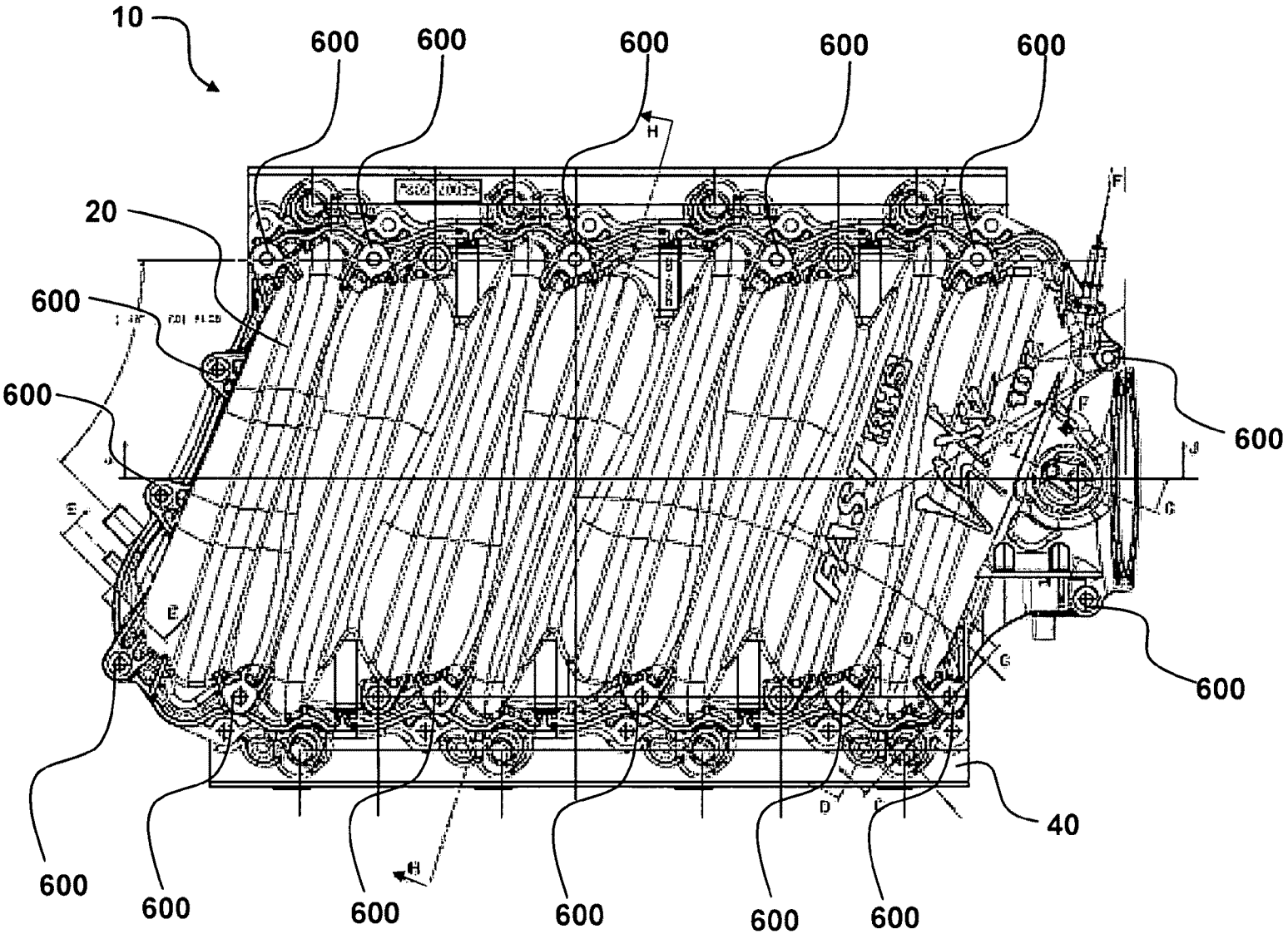
FIG. 9 corresponds to view E-E of FIG. 2 and is a top view of an intake manifold assembly, in accordance with aspects of the present invention.

As shown in FIGS. 2 and 9, once the shell 20 is aligned with the base member 40, openings 480 in the mating flange 440 may align with the through-holes 230 in the mating surface 50, for example. Fasteners 600, such as bolts, for example, may be inserted through the openings 480 and through-holes 230 from above, and secured from below by an appropriate securing device, such as through tightening a nut, for example. The fasteners 600, for example, may thus extend through the mating flange 440 of the shell 20 and the base member 40, creating a clamping force to hold the engine manifold assembly 10 together, with the runners 30 secured between the shell 20 and the base member 40.

Figure 10:
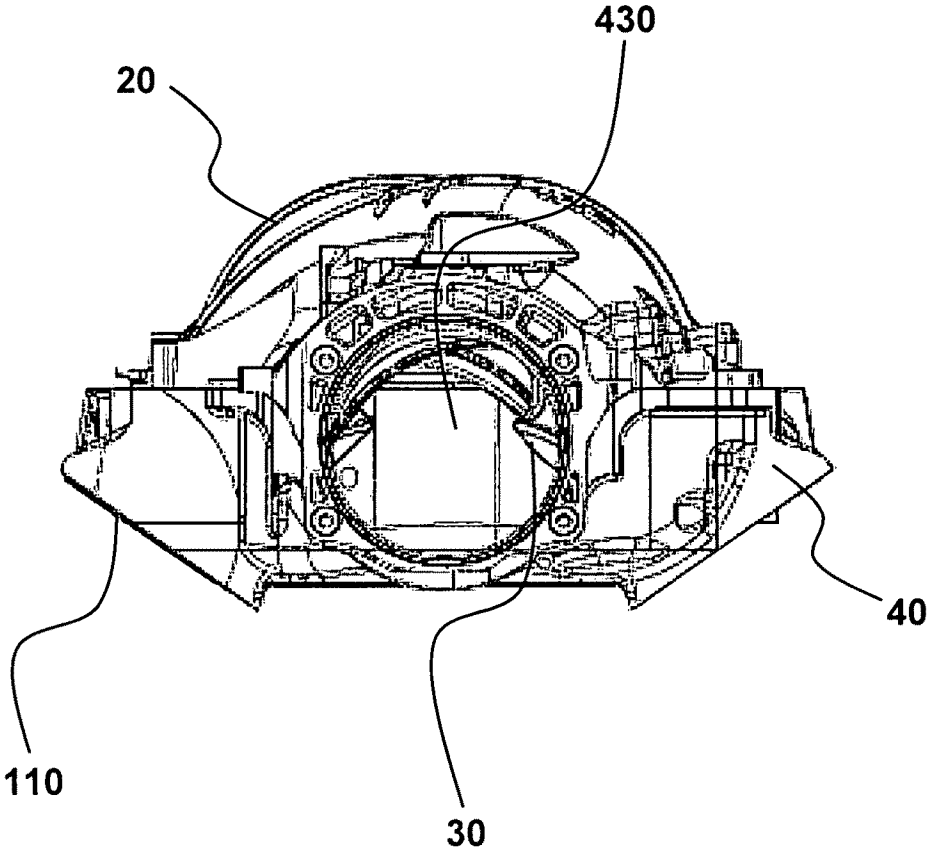
FIG. 10 shows a front view of an intake manifold assembly, in accordance with aspects of the present invention.
Figure 11A:
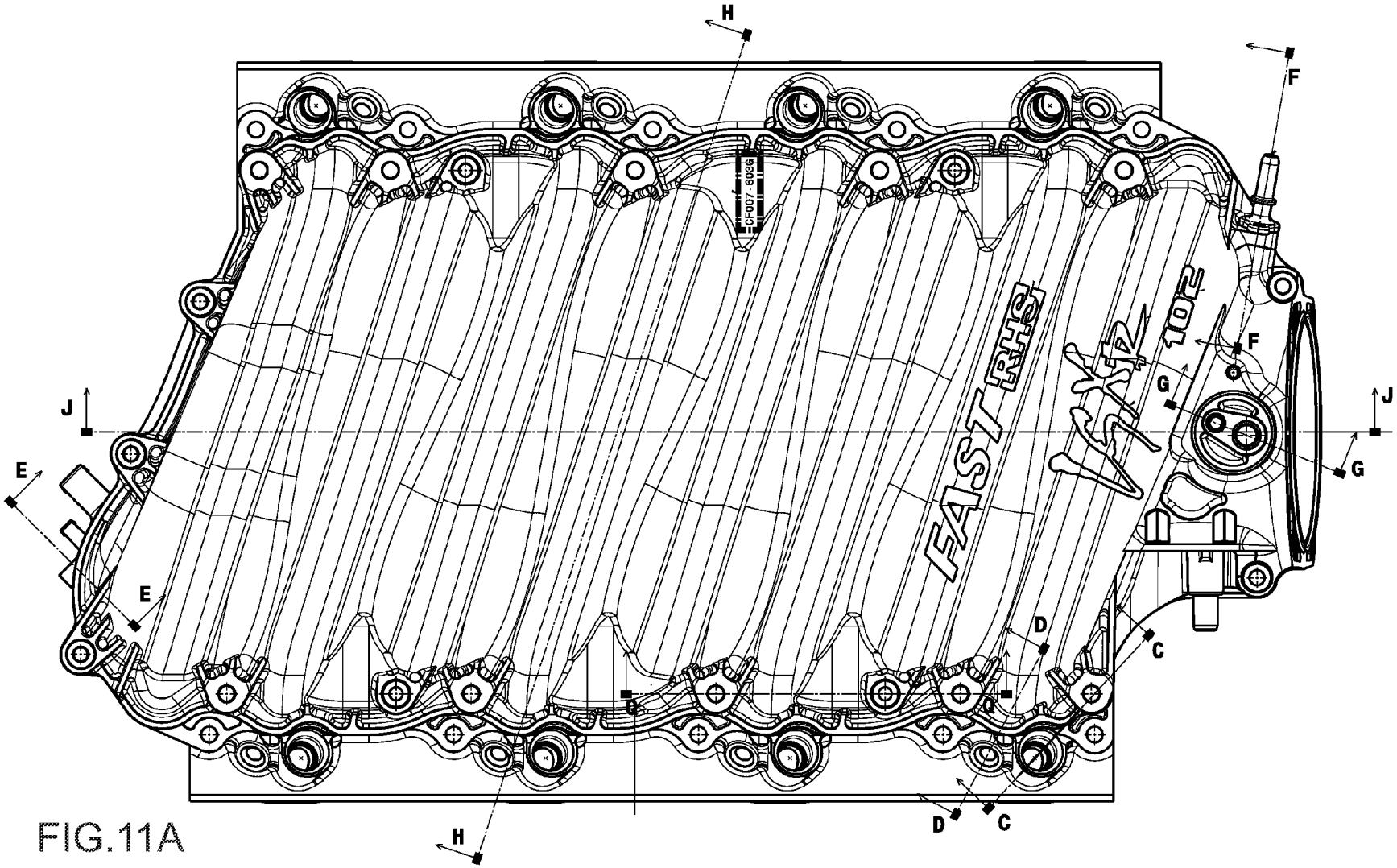
FIGS. 11A-11E show various views and cross-sectional views of an exemplary intake manifold assembly, in accordance with aspects of the present invention.
Figure 11B:
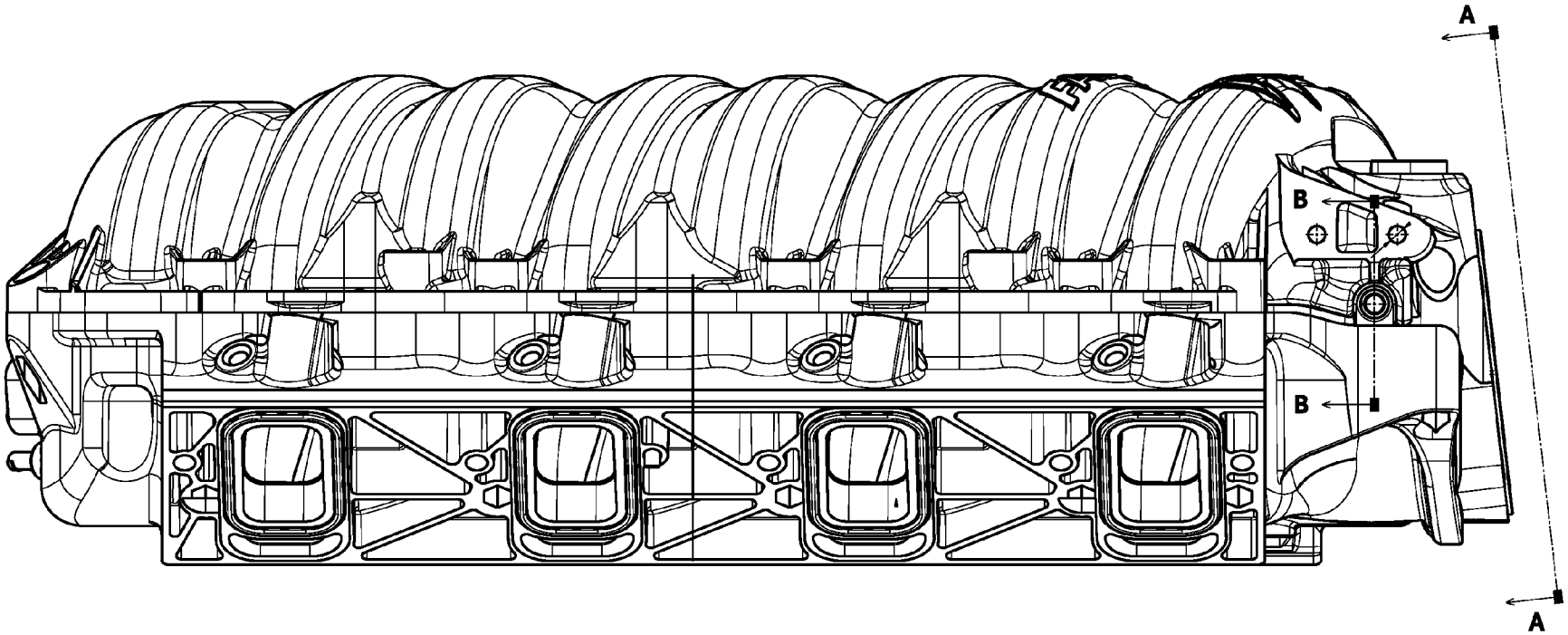
Figure 11C:
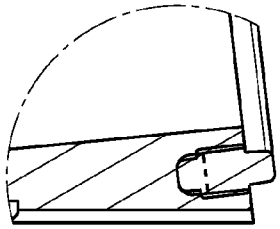
Figure 11D:
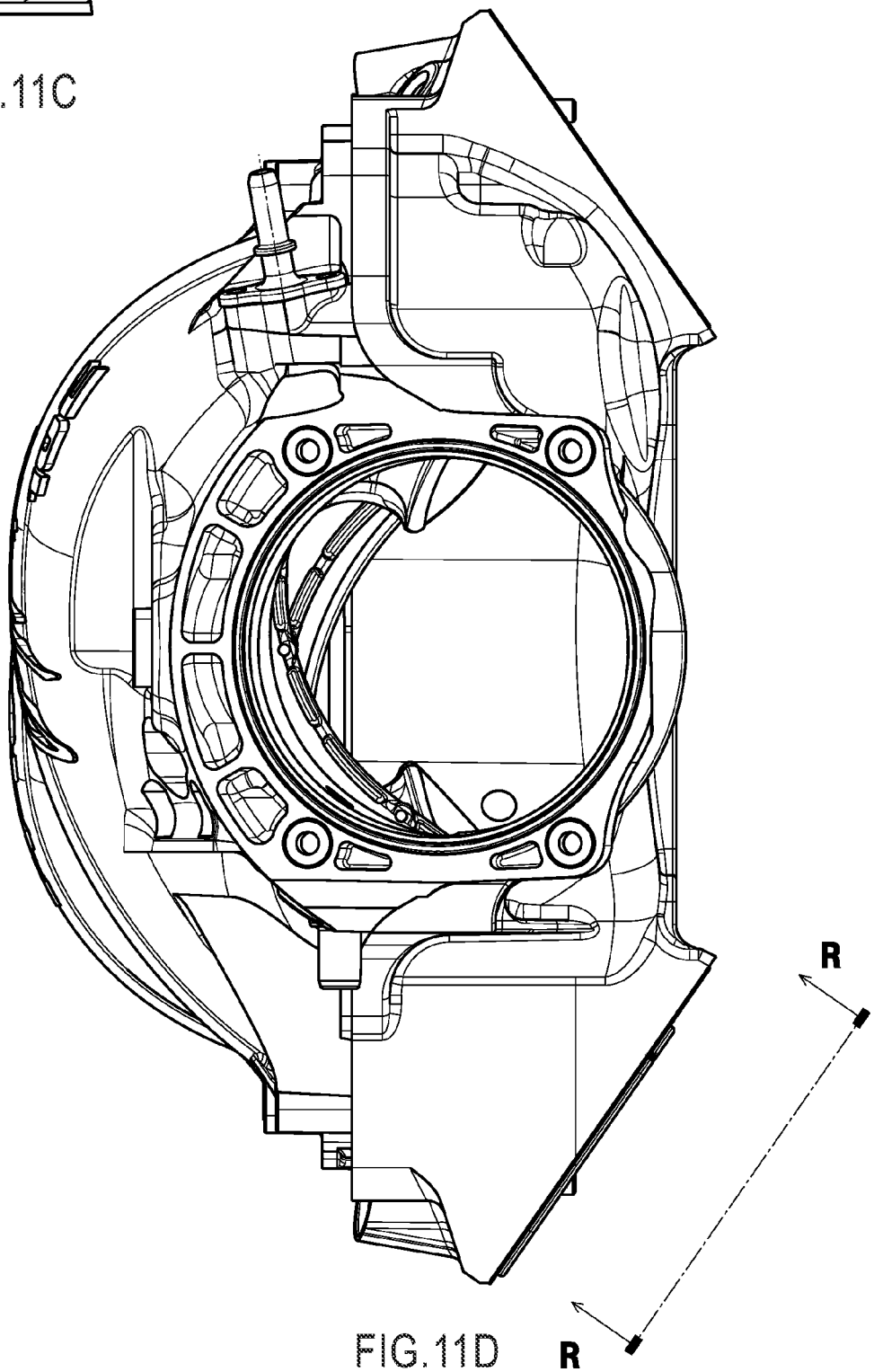
Figure 11E:
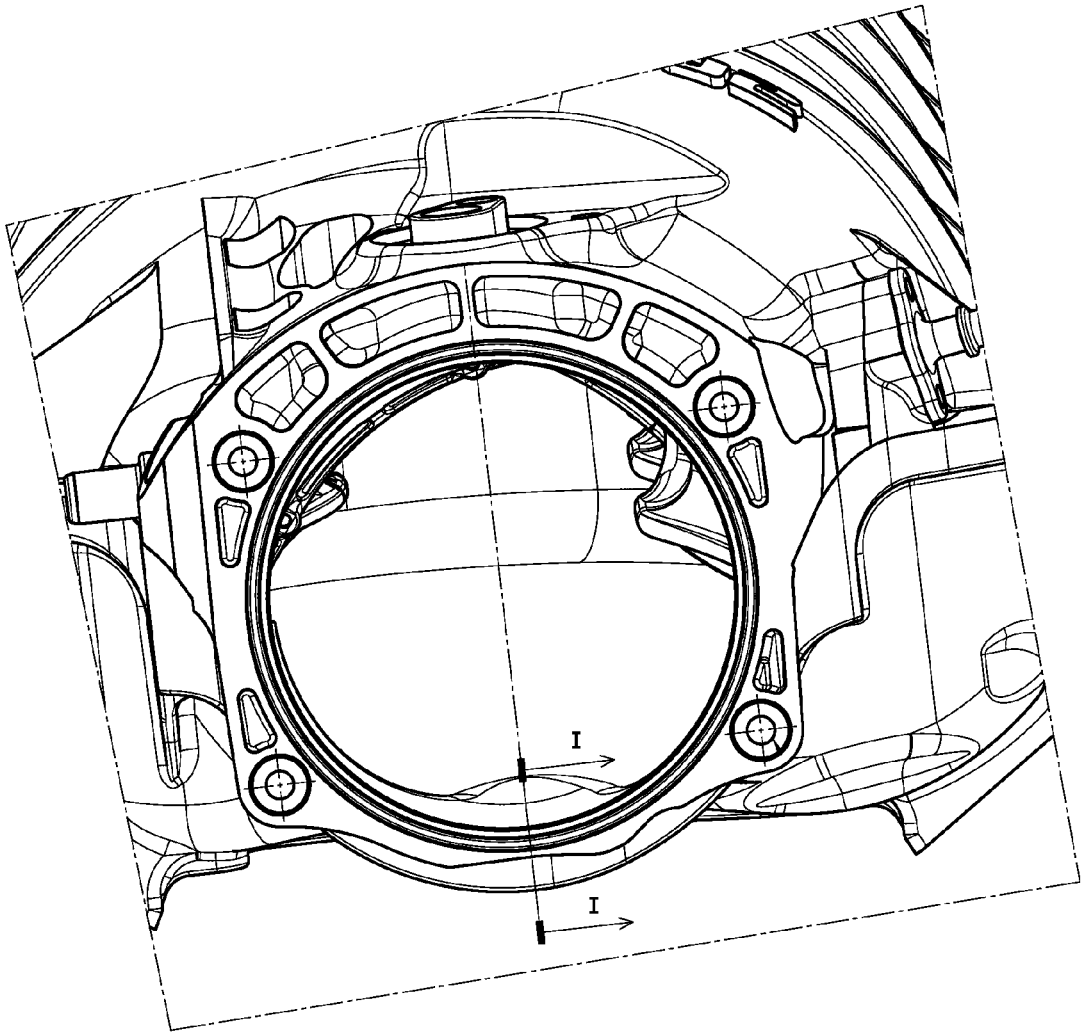
Figure 12A:
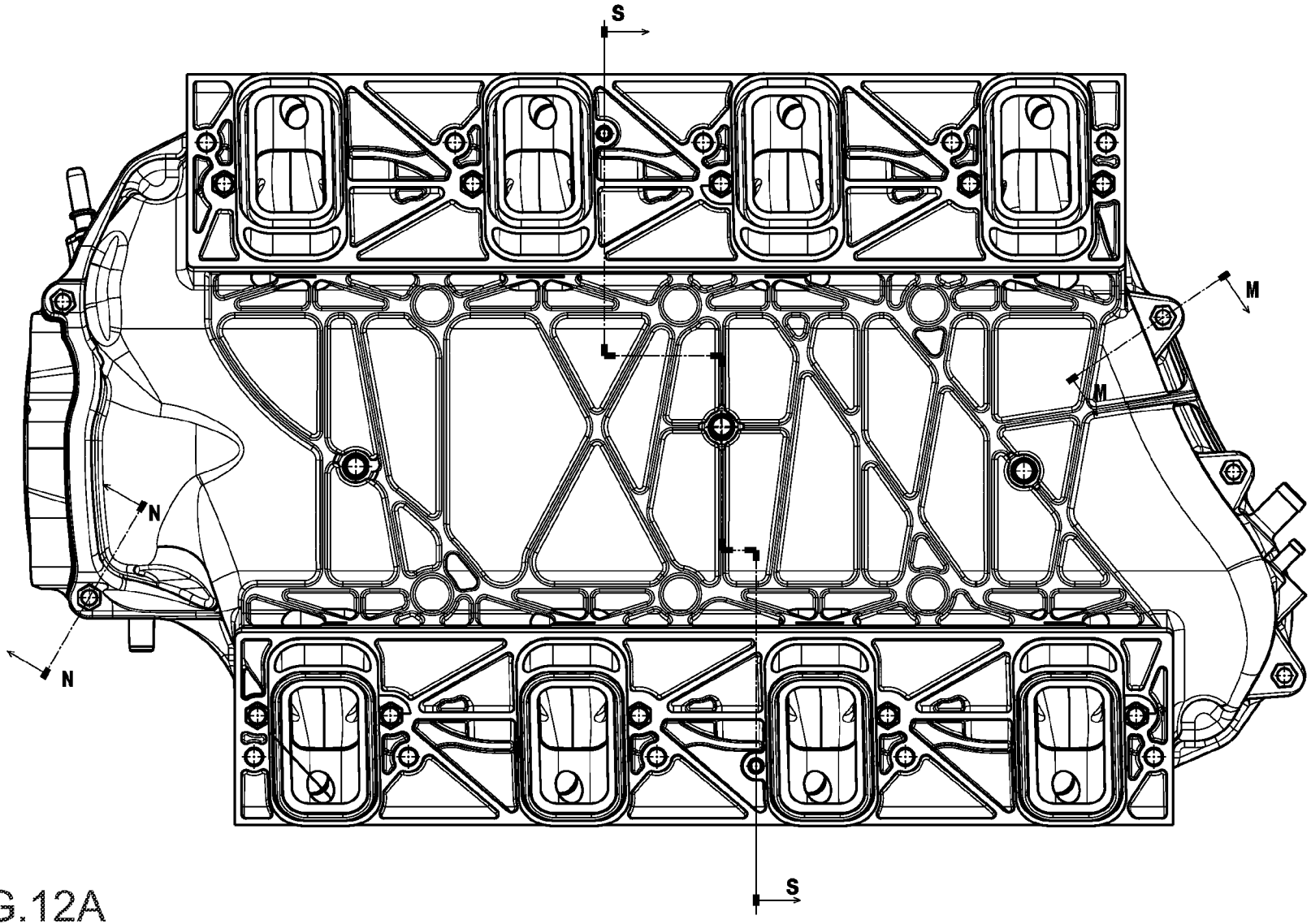
FIGS. 12A-12G show various views and cross-sectional views of an exemplary intake manifold assembly, in accordance with aspects of the present invention.
Figure 12B:
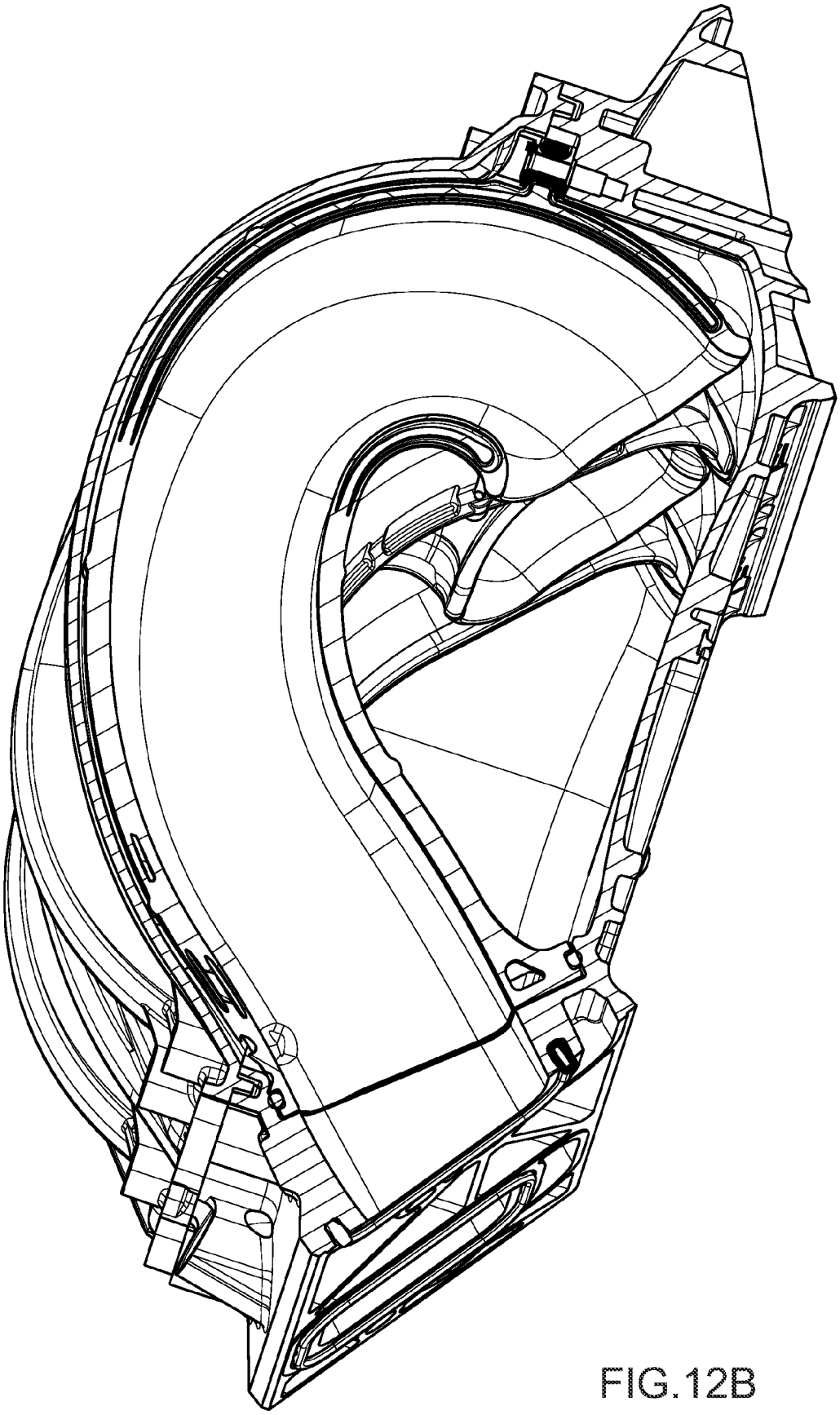
Figure 12C:
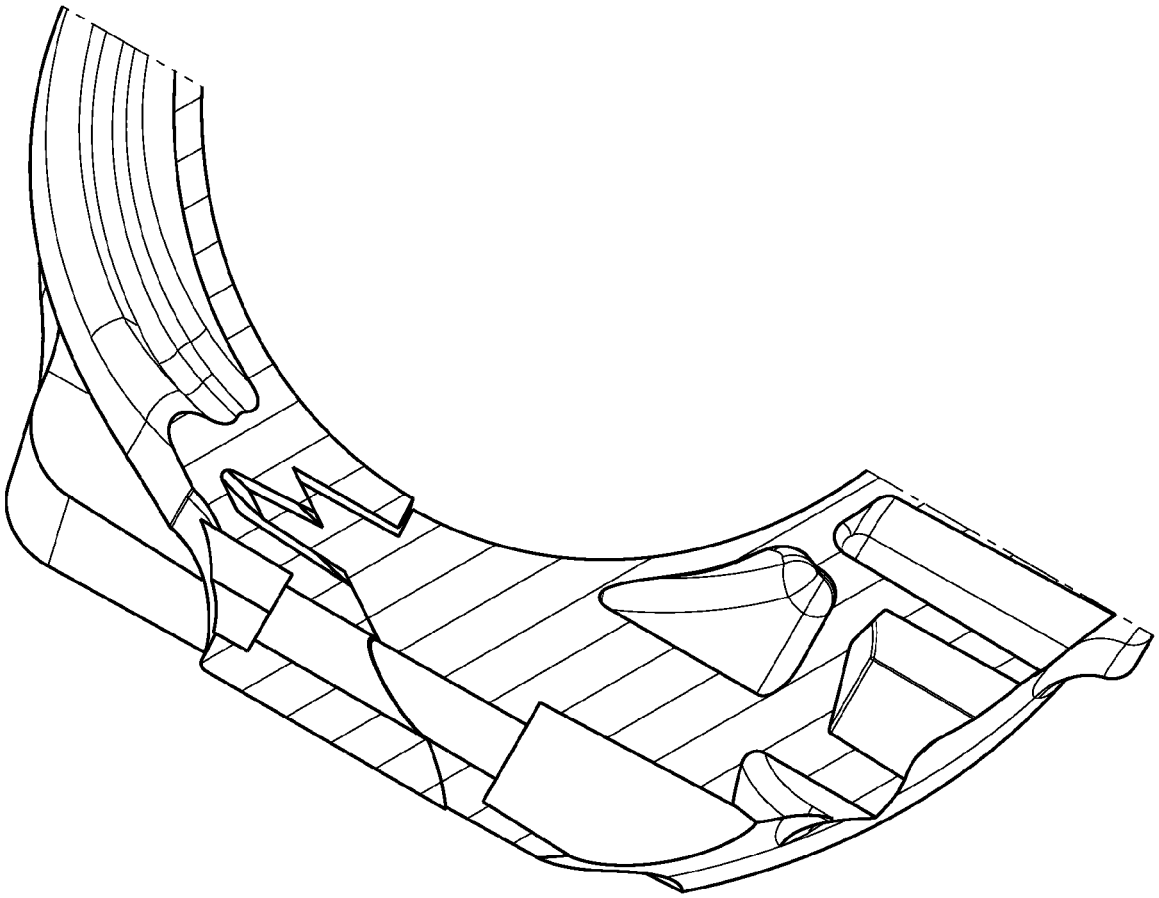
Figure 12D:
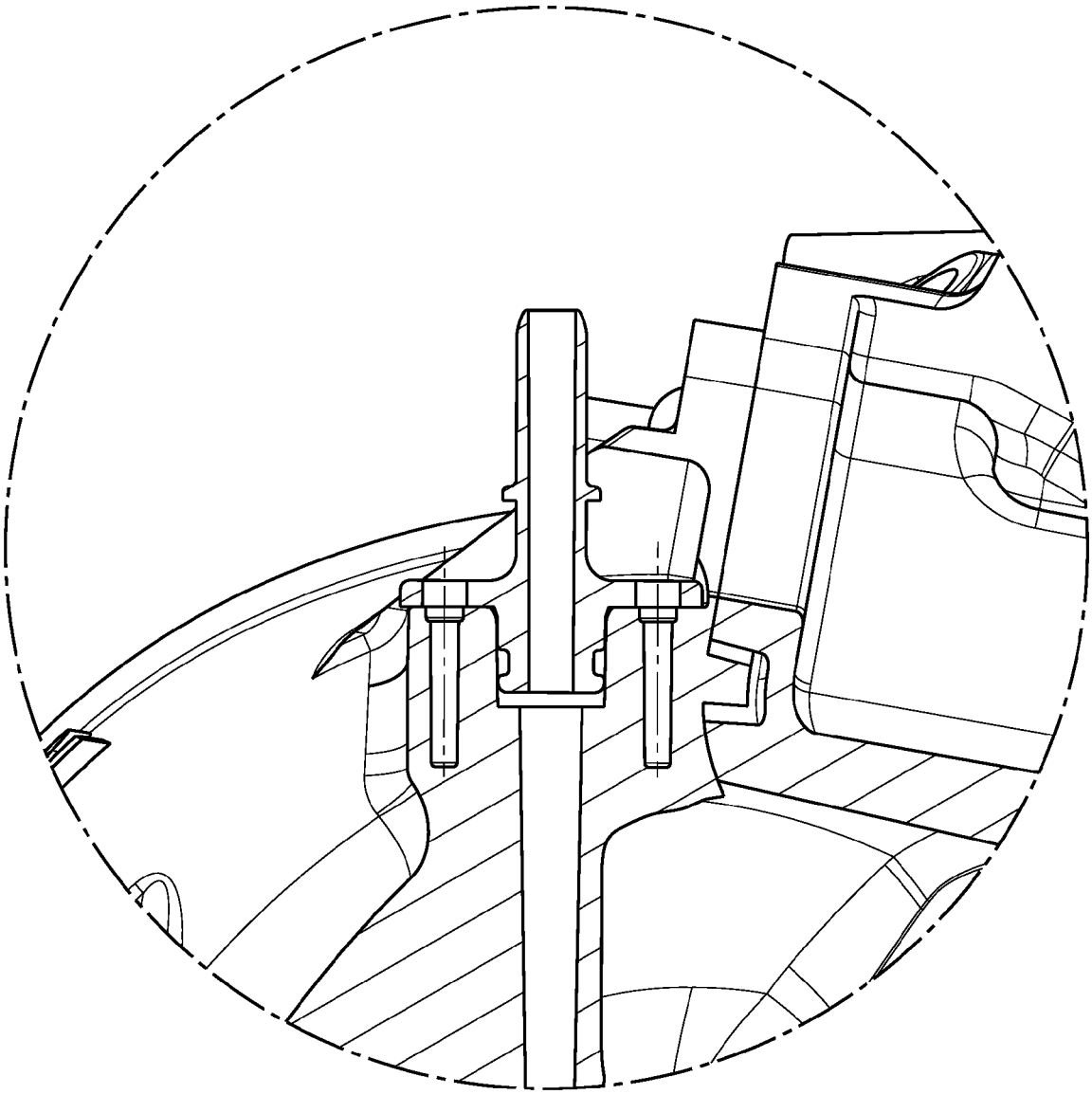
Figure 12E:
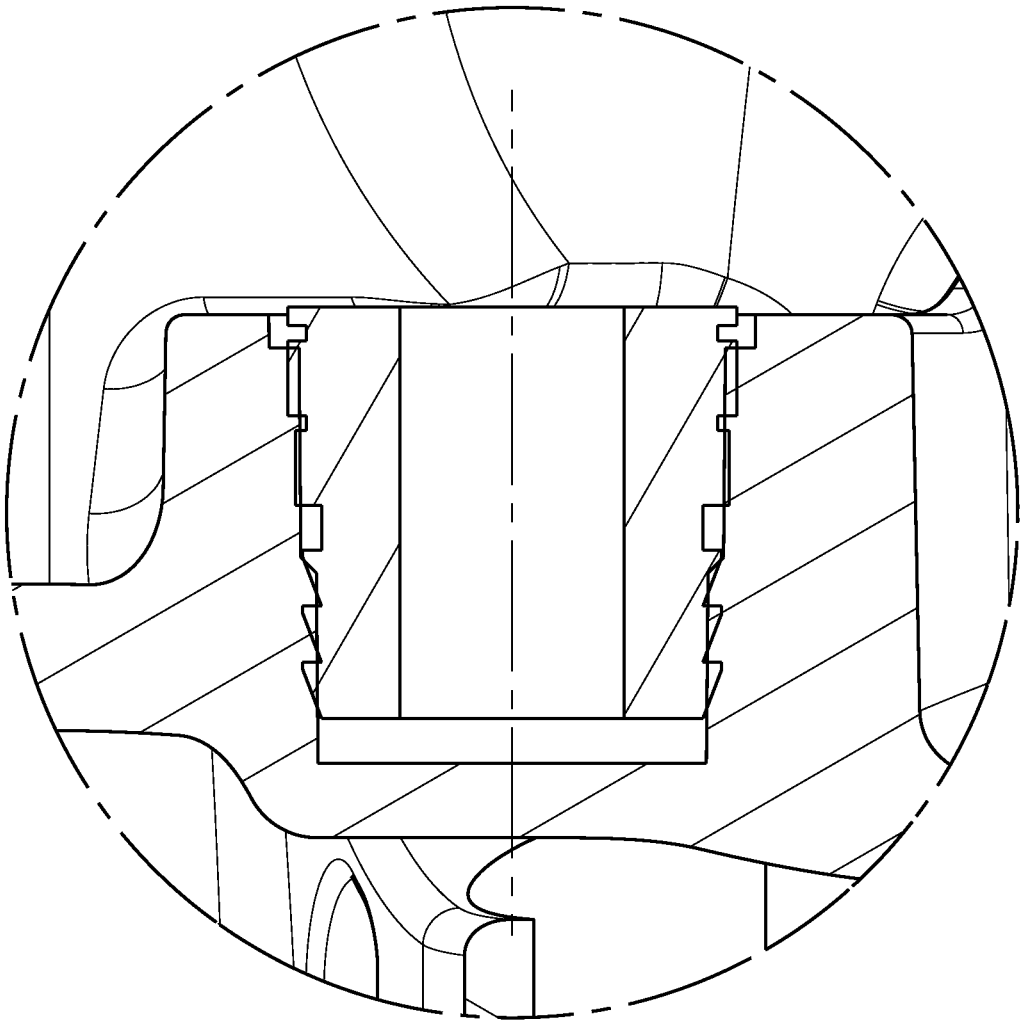
Figure 12F:
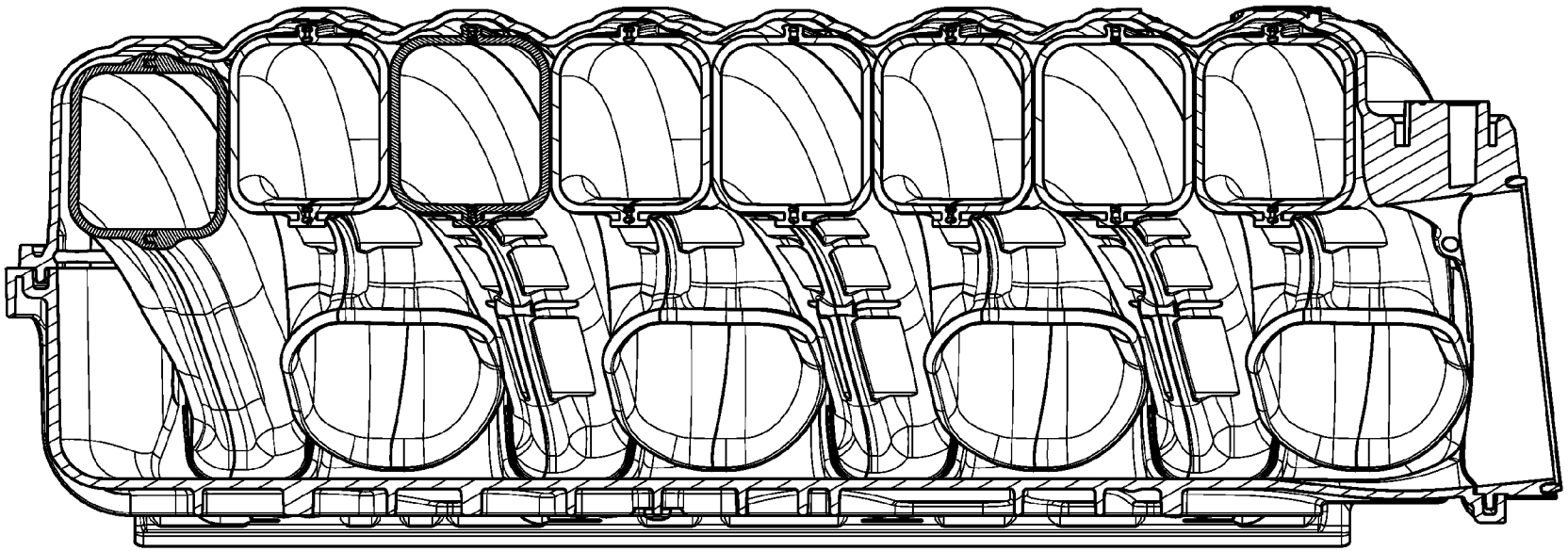
Figure 12G:
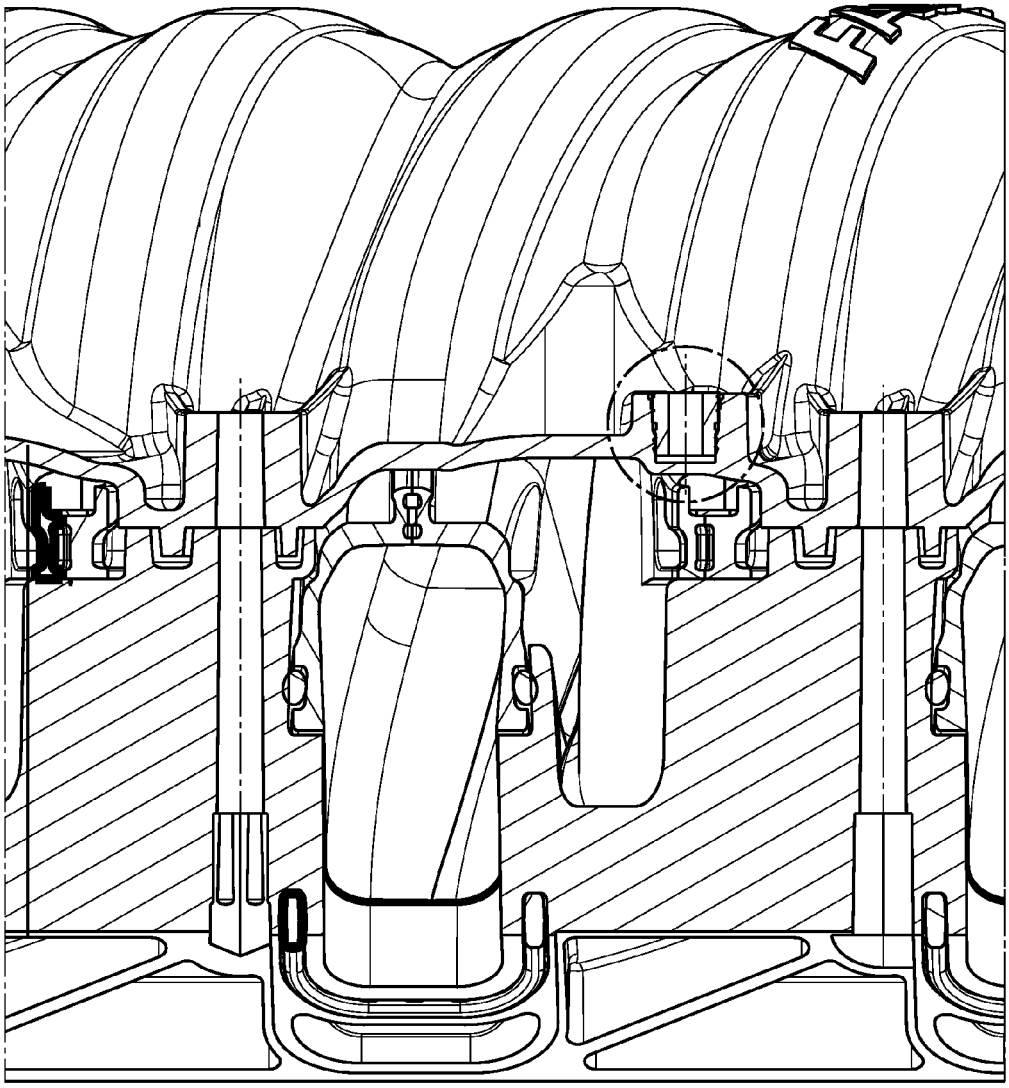
Figure 13A:
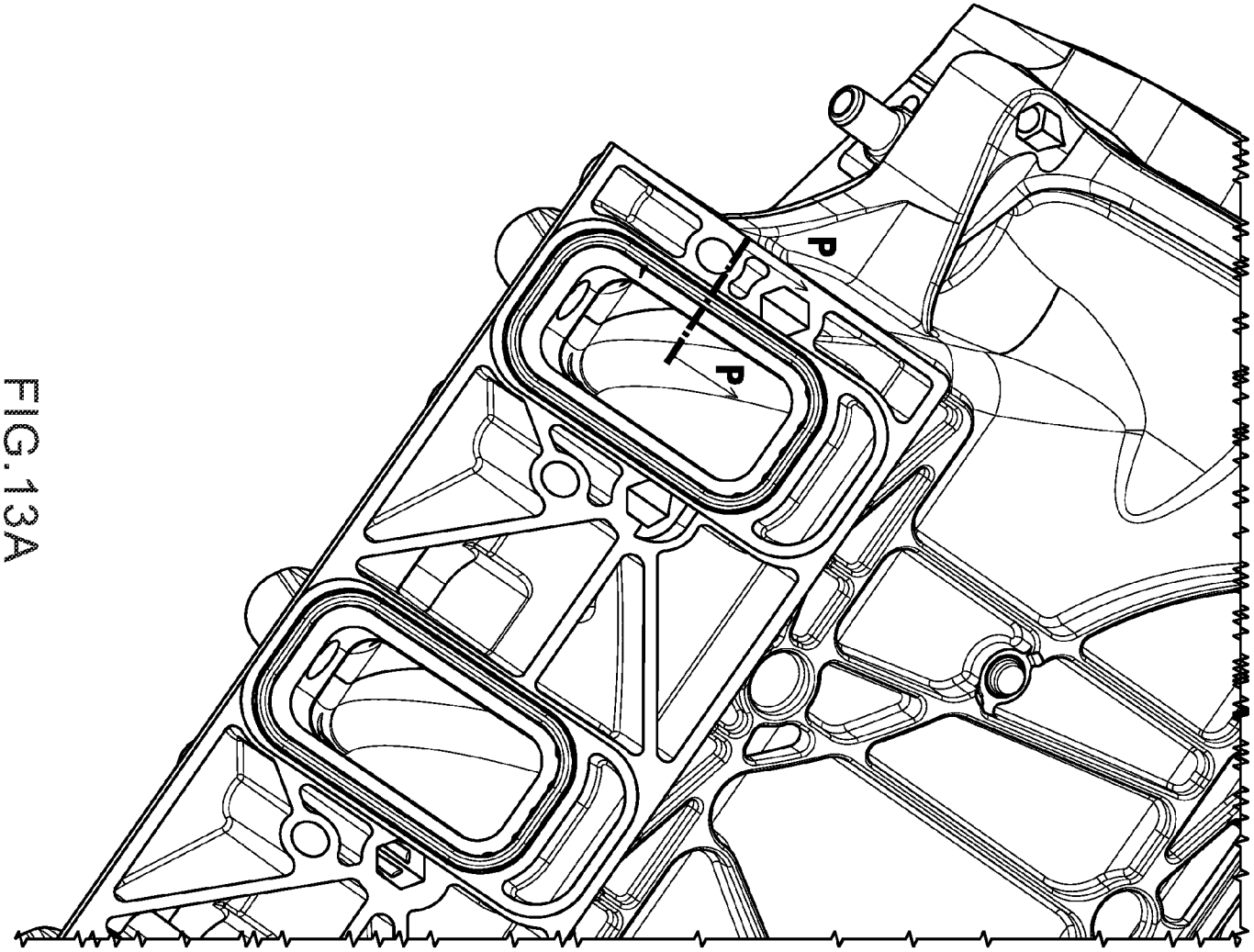
FIGS. 13A-13K show various views and cross-sectional views of an exemplary intake manifold assembly, in accordance with aspects of the present invention.
Figure 13B:
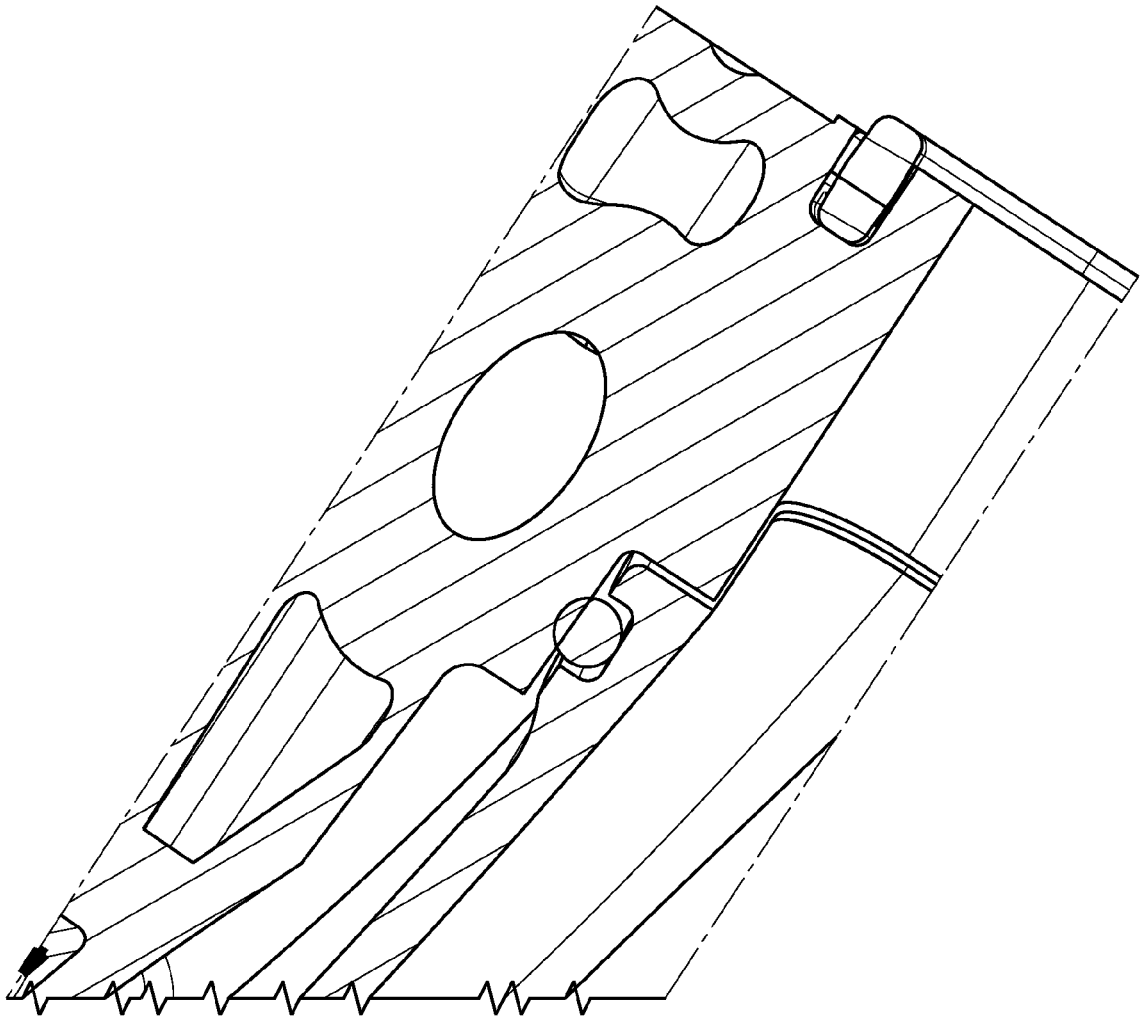
Figure 13C:
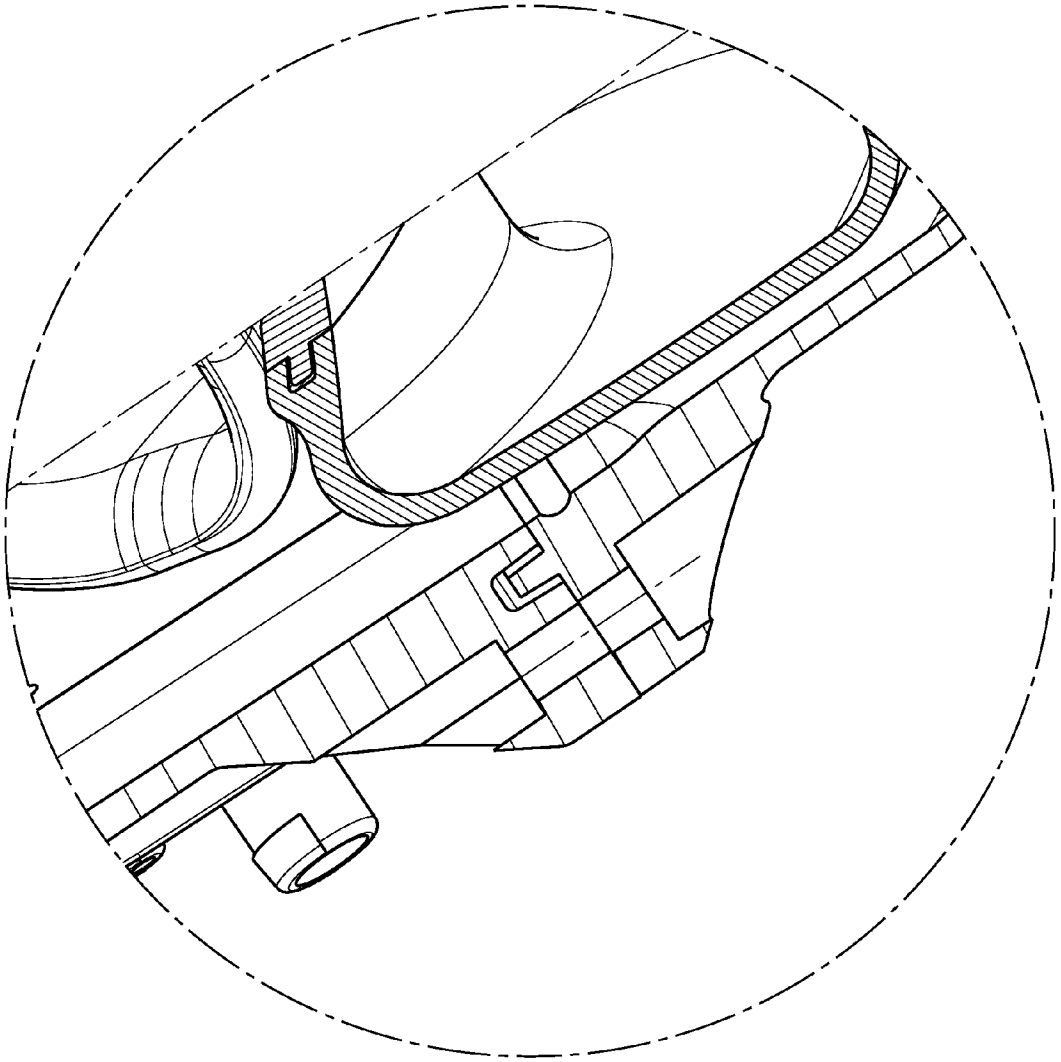
Figure 13D:
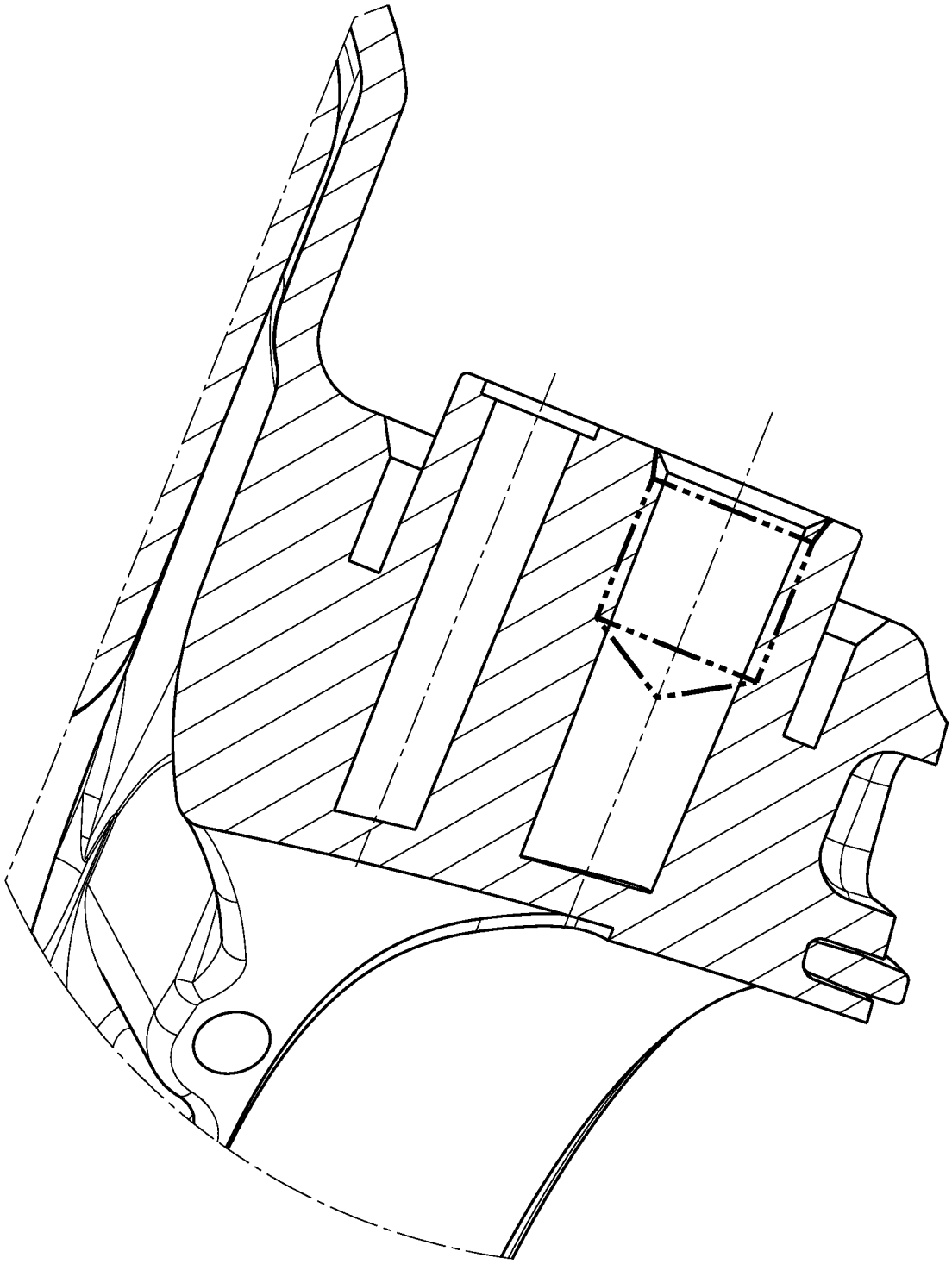
Figure 13E:
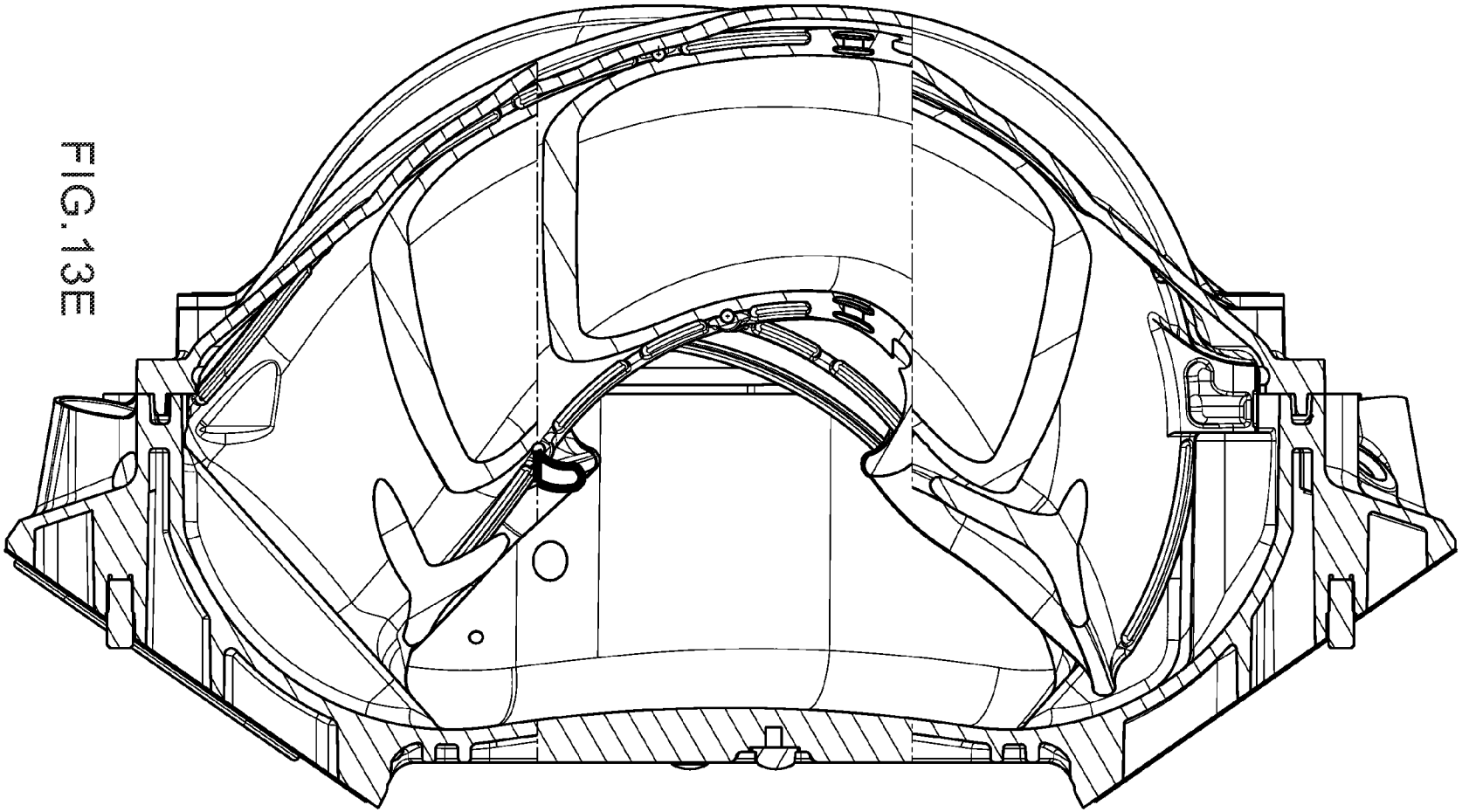
Figure 13F:
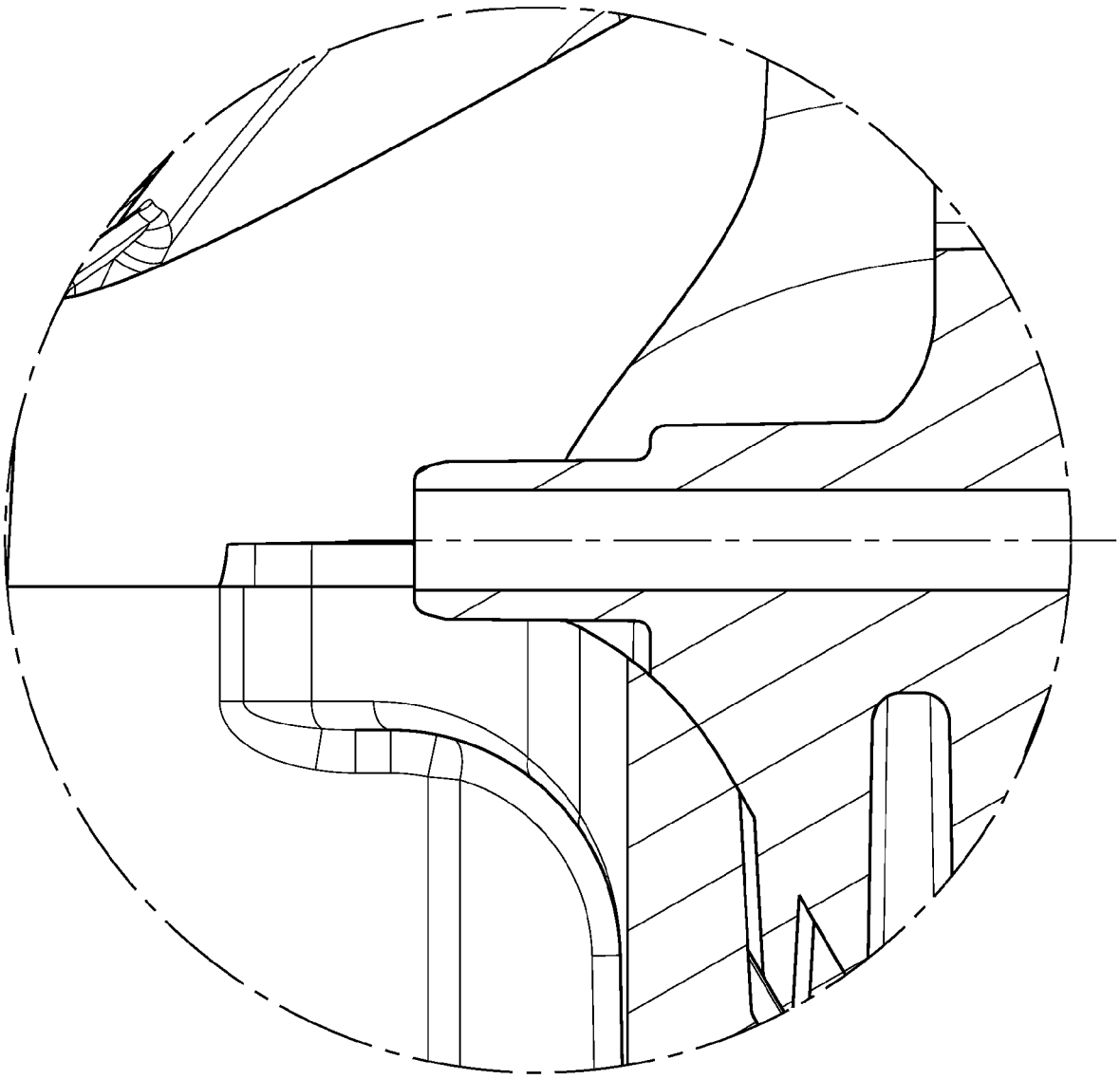
Figure 13G:
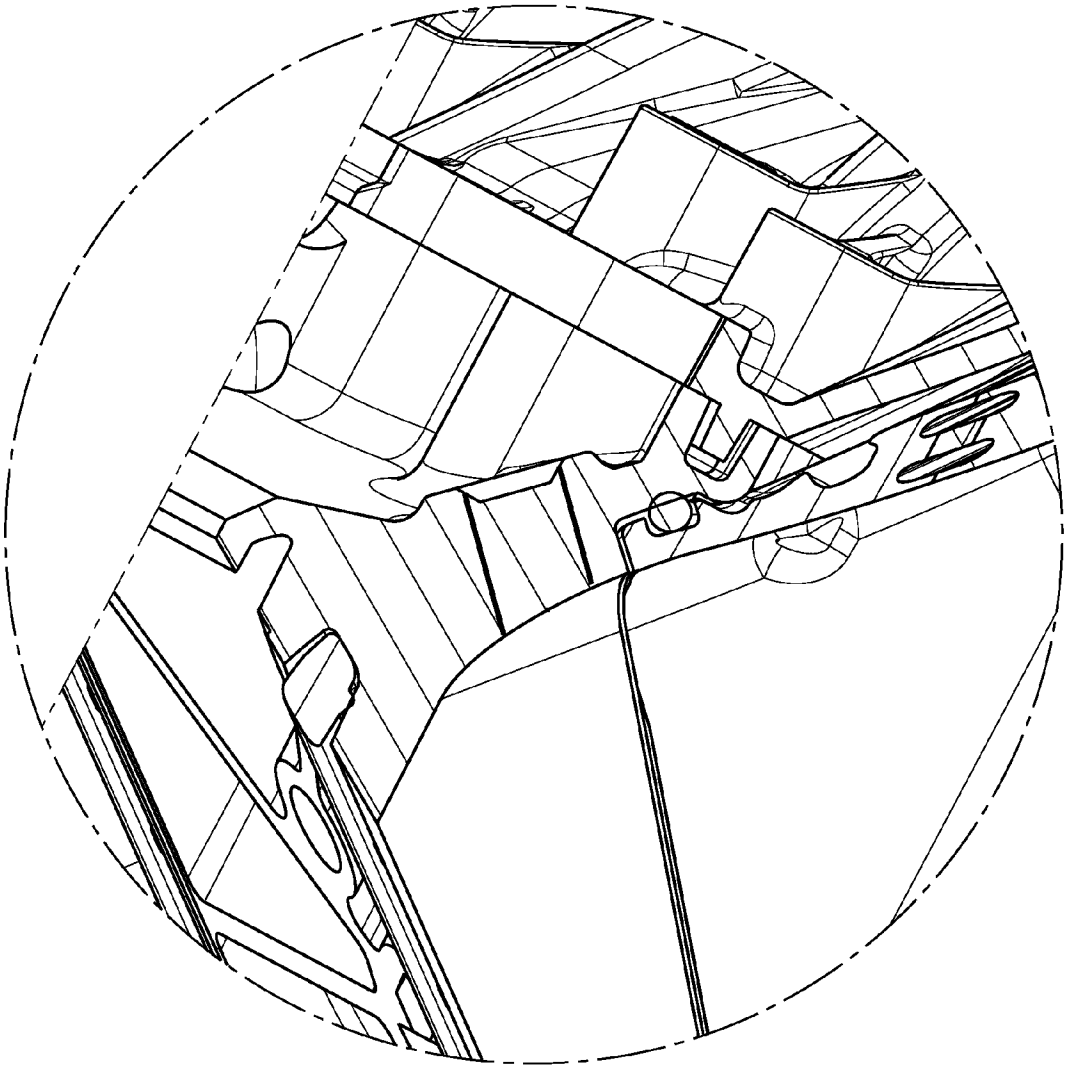
Figure 13H:
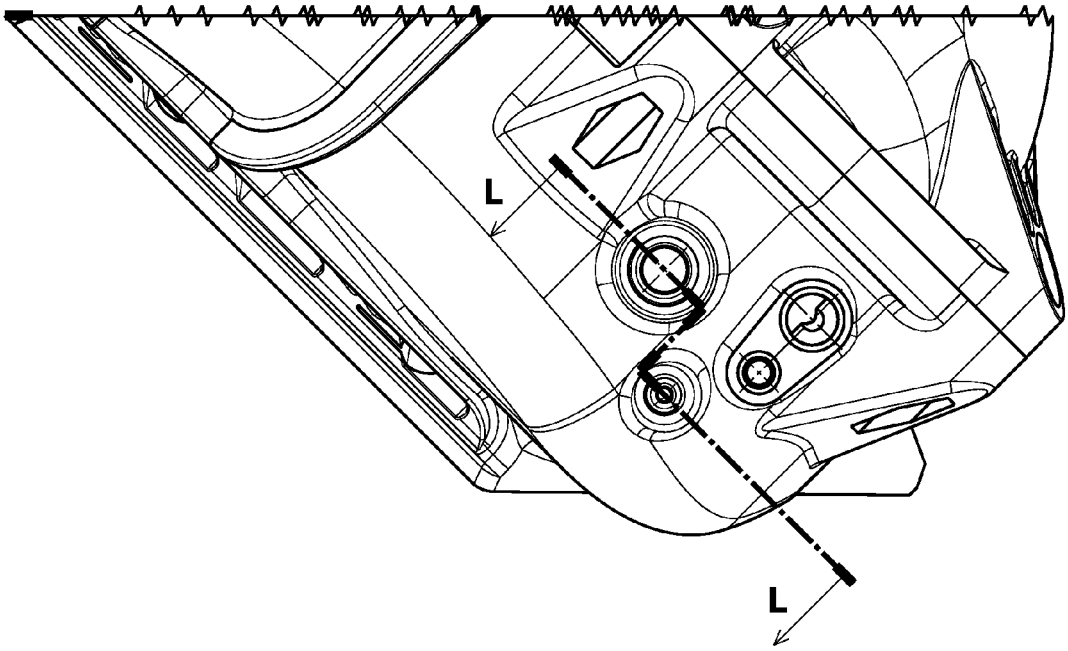
Figure 13I:
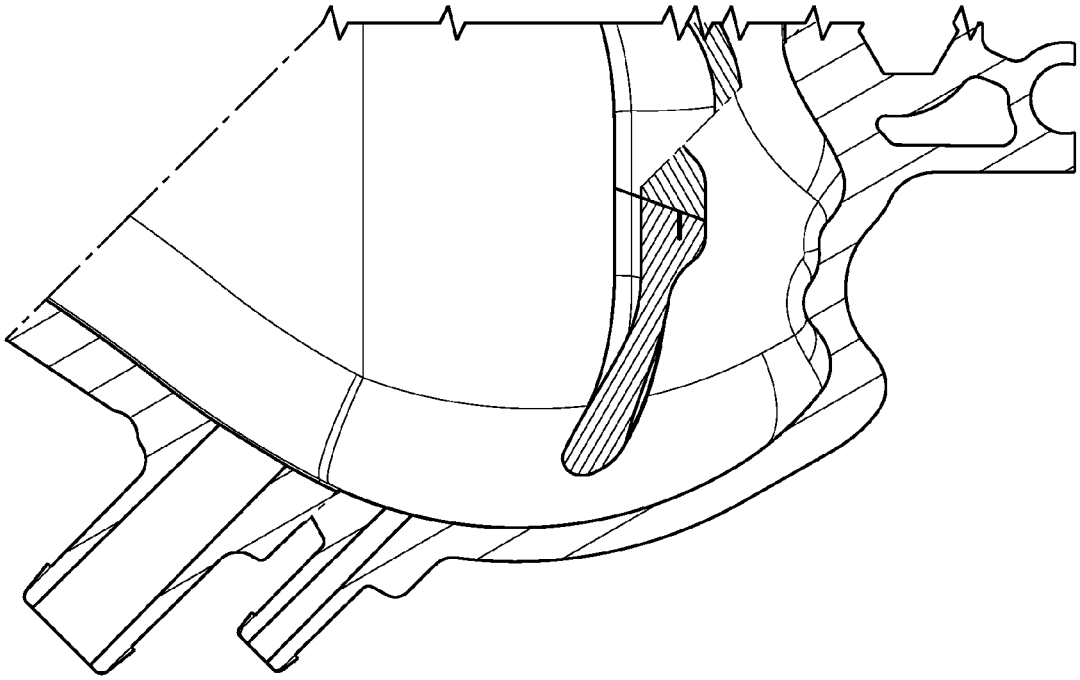
Figure 13J:
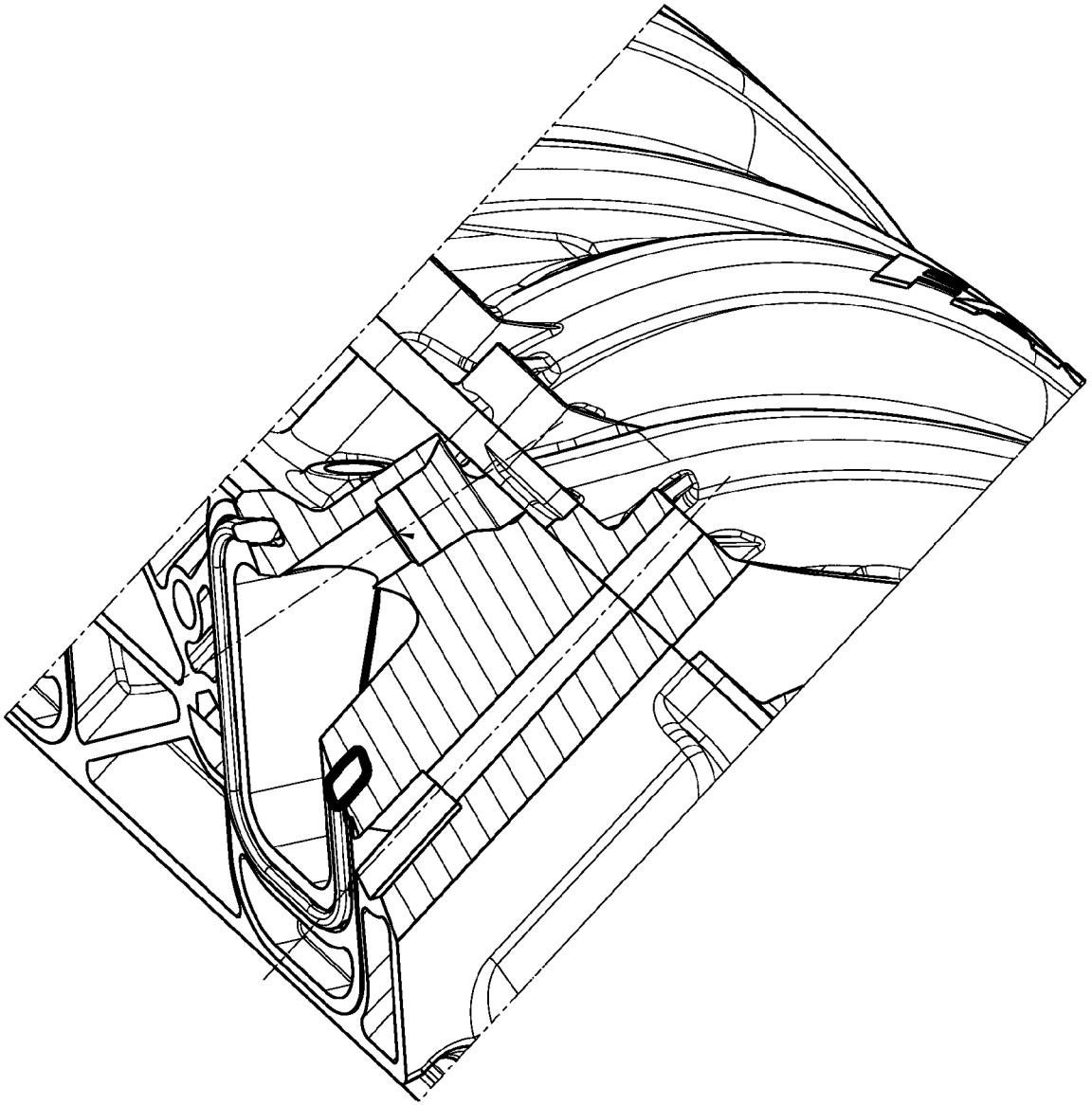
Figure 13K:
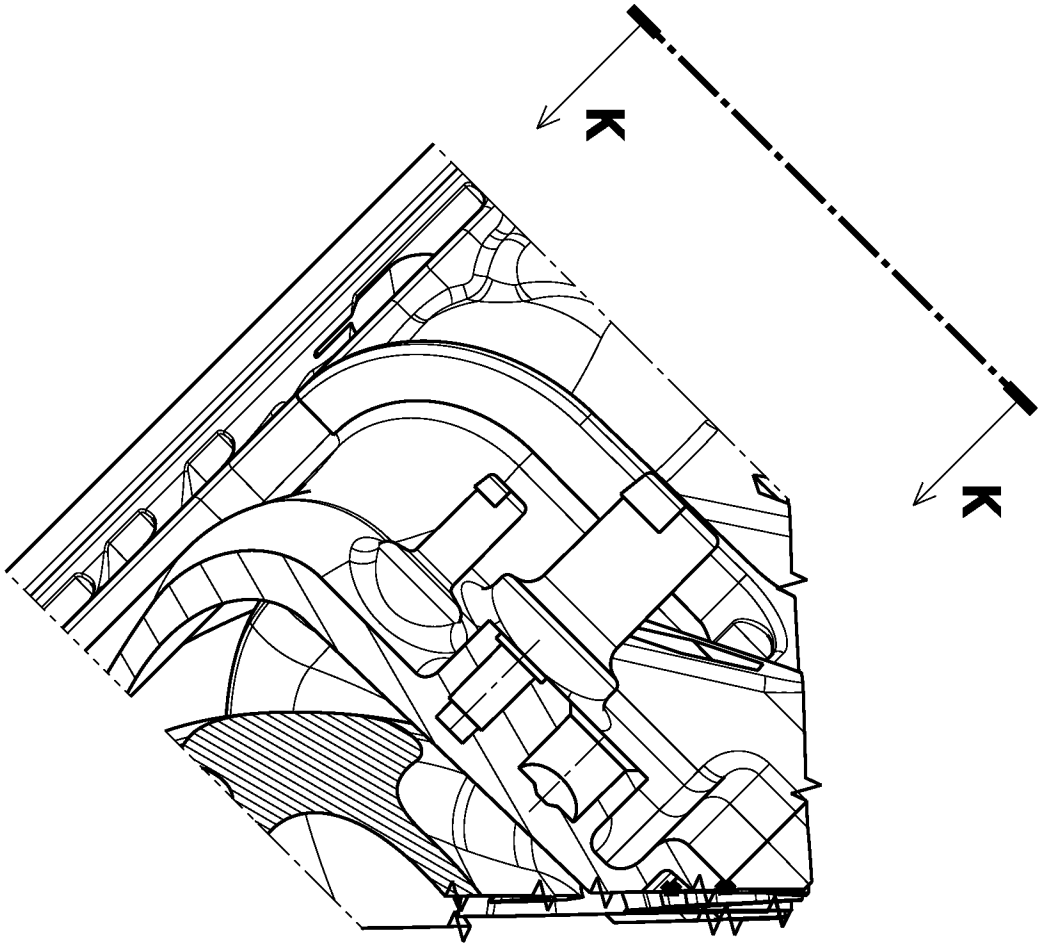

As shown in FIG. 10, when assembled, the interior of the intake manifold assembly 10 may communicate with the exterior via the inlet 430 of the shell 20 and air outlets 110 in the base member 40. In operation, the intake manifold assembly 10 accepts incoming air through inlet 430. The air then travels into the plenum chamber between the shell 20 and the base member 40 and is drawn in through the plenum sections 37 of the individual runners 30. The air travels the lengths of the respective runners 30 and through the air outlets 110 formed in the base member 40, at which time the air flows into the inlet ports in the cylinder heads 80 and 90 of the engine 100.

The volume and velocity of air traveling through an intake manifold is limited by the size and shape of the inlet of the intake manifold. Generally speaking, the larger the inlet 430 of the intake manifold 10, the larger the volume of air that can be directed into the engine 100. Traditionally, intake manifold modification has been limited to altering only certain easily accessible features, such as inlet size or air outlet size, because of the single component or permanently bonded types of construction. However, these features may be altered only to a degree, past which the part is no longer usable. Alternatively, intake manifold modification has constituted removing the installed intake manifold, obtaining an entirely new intake manifold with features of differing shapes or sizes, such as a smaller or larger inlet, and attaching the new intake manifold to the engine. This process can include a substantial financial cost for both purchase of a new part and labor for installation, not to mention the risk of damage being done to the engine during removal and exchange of entire manifold assemblies. However, an intake manifold assembly in accordance with aspects of the invention described above, provides significant benefits.

First, the intake manifold assembly 10 can be made to allow for a larger volume of air by simply removing the shell 20 having an inlet 430 of a given diameter, 92 mm for example, and replacing it with a shell 20 having an inlet 430 with a different diameter, 102 mm for example. Replacing only the shell 20 versus the entire intake manifold 10 results in a lower cost and less waste. Second, an added benefit of the present invention is the ability to simply unbolt the shell 20 and remove, replace and or exchange one or more of the individual runners 30 with runners 30 of different lengths or shapes, for example. The length and shape of the runners 30 directly affects how air flows within the intake manifold 10, and hence, how the air is delivered to the engine 100. Therefore, the interchangeability of the runners 30 is also advantageous from an engine tuning perspective. For example, different runners 30 may be designed to serve different target performance ranges. Thus, different runners 30 may be used with the same or different base members 40, for example, to serve different engine displacements and revolution per minute (rpm) ranges. The ability to unbolt the shell 20 from the base member 40 to access and/or exchange the runners 30, and then simply bolt the intake manifold assembly 10 back together, eliminates the welding, gluing, and other cumbersome requirements typical with most intake manifolds.

By modular construction of the intake manifold assembly 10, the shell 20 and/or the runners 30 can be changed without having to disassemble the base member 40 from the engine 100. Therefore the seals between the mating faces 40 and 50, the gaskets 570, and the mating surfaces of the cylinder heads 80 and 90 remain intact. Accordingly, there is less risk of debris entering into the engine 100 and, therefore, less risk of internal engine damage.

The ability to construct each and every component of the modular intake manifold assembly 10 from an advanced polymer material, for example, provides the added benefits of lighter weight, increased strength and improved heat dissipating characteristics. The injection molded design of the various components of the intake manifold assembly 10 allows perfect bolt-on fitment for the use of factory accessories without modification or clearance concerns, including integrated nitrous bungs and provisions for various Positive Crankcase Ventilation (PCV) features, vacuum nipples, fuel rails, and throttle body linkages, for example.

FIGS. 11A-11E, 12A-12G, and 13A-13K show various views and cross-sectional views of an exemplary intake manifold assembly 10 as described above and in accordance with aspects of the present invention.

While this invention has been described in conjunction with the exemplary aspects outlined above, various alternatives, modifications, variations, improvements, and/or substantial equivalents, whether known or that are or may be presently unforeseen, may become apparent to those having at least ordinary skill in the art. Accordingly, the exemplary aspects of the invention, as set forth above, are intended to be illustrative, not limiting. Various changes may be made without departing from the spirit and scope of the invention. Therefore, the invention is intended to embrace all known or later-developed alternatives, modifications, variations, improvements, and/or substantial equivalents.

What is claimed is:

1. A modular intake manifold assembly for an internal combustion engine, comprising:

a base member having an inlet, a mating face, and an air outlet providing communication through the mating face;

a plurality of self-contained tubular runners, each self-contained runner having an inlet and an outlet; and a shell;

wherein the base member removably attaches to an upper portion of the internal combustion engine;

wherein the shell removably attaches to the base member to form an internal chamber; and wherein each self-contained tubular runner is independently positionable in the internal chamber between the base member and the shell with the inlet in communication with the internal chamber and the outlet extending to the air outlet of the base member.

2. The intake manifold assembly of claim 1, wherein the shell is removable from the intake manifold assembly without removing the base member or the self-contained tubular runner.

3. The intake manifold assembly of claim 1, wherein at least one of the base member, the self-contained tubular runner, and the shell comprise a polymer.

4. The intake manifold assembly of claim 1, wherein the self-contained tubular runner further comprises:

a flanged section formed to mate with an edge of the air outlet.

5. The intake manifold assembly of claim 4, wherein the flanged section has a peripheral groove for providing a seal between the self-contained tubular runner and the base member.

6. The intake manifold assembly of claim 1, wherein the shell encloses the self-contained tubular runner within the internal chamber.

7. The intake manifold assembly of claim 6, wherein the shell comprises contours on an upper surface for accommodating the self-contained tubular runner within the internal chamber.

8. The intake manifold assembly of claim 1, further comprising:

a fastener for attaching the self-contained tubular runner to the base member, wherein the shell is formed so as to retain the fastener between the shell and the base member when the shell is attached to the base member.

9. The intake manifold assembly of claim 1, further comprising:

a bumper affixed to a lower surface of the base member, wherein the bumper abuts an upper surface of the internal combustion engine.

10. The intake manifold assembly of claim 1, wherein the air outlet includes a raised pad and a seal groove about an external perimeter of the raised pad for providing a seal between the air outlet and the internal combustion engine.

11. The intake manifold assembly of claim 1, wherein the base member further comprises:

an upper mating surface having a sealing groove therein, wherein the shell comprises a mating flange and a sealing ridge extending from a surface of the mating flange, and wherein a sealing material is provided within the sealing groove that is retained by the sealing ridge when the shell is attached to the base member.

12. An intake manifold having a modular construction, comprising:

a base member having an internal cavity, an inlet, two mating faces provided on opposite sides of the internal cavity, and a series of air outlets providing communication through the mating faces;

a shell having a throttle body mounting boss, an inlet for providing an air intake to the internal cavity, and an upper portion for enclosing the internal cavity; and a series of self-contained tubular runners, each self-contained tubular runner having an inlet that communicates with the air intake in the internal cavity and an outlet, wherein the outlets of adjacent self-contained tubular runners extend in opposite directions from the inlets to air outlets in opposing mating faces of the base member; and wherein the base member removably attaches to a portion of an internal combustion engine;

wherein each self-contained tubular runner removably couples to the base member and is independently positionable in the internal cavity between the shell and the base member; and wherein the shell removably attaches to the base member.

13. The intake manifold of claim 12, wherein the shell is removable from the intake manifold without removing the base member or the self-contained tubular runner.

14. The intake manifold of claim 12, wherein at least one of the base member, the self-contained tubular runner, and the shell comprise a polymer.

15. The intake manifold of claim 12, wherein each self-contained tubular runner further comprises:

a flanged section formed to mate with an edge of the air outlet.

16. The intake manifold of claim 15, wherein the flanged section has a peripheral groove for providing a seal between the self-contained tubular runner and the base member.

17. The intake manifold of claim 12, wherein the shell encloses the self-contained tubular runners within the internal cavity.

18. The intake manifold of claim 17, wherein the shell comprises contours on a surface for accommodating the self-contained tubular runner within the internal cavity.

19. The intake manifold of claim 12, further comprising:

a fastener for attaching the self-contained tubular runner to the base member, wherein the shell is formed so as to retain the fastener between the shell and the base member when the shell is attached to the base member.

20. The intake manifold of claim 12, further comprising a bumper affixed to a lower surface of the base member, wherein the bumper abuts an upper surface of the internal combustion engine.

21. The intake manifold of claim 12, wherein each air outlet includes a raised pad and a seal groove about an external perimeter of the raised pad for providing a seal between the air outlet and the internal combustion engine.

22. The intake manifold of claim 12, wherein the base member further comprises:

an upper mating surface having a sealing groove therein;

wherein the shell comprises:

a mating flange, and a sealing ridge extending from a lower surface of the mating flange, and wherein a sealing material is provided within the sealing groove that is compressed by the sealing ridge when the shell is attached to the base member.

23. A method of assembling an intake manifold for an internal combustion engine, the method comprising:

removably attaching a base member to a portion of the internal combustion engine, wherein the base member comprises an inlet, a mating face, and a plurality of air outlets providing communication through the mating face;

removably attaching a plurality of self-contained tubular runners to the base member, wherein each self-contained tubular runner has an inlet and an outlet, and wherein each self-contained tubular runner is independently positioned to have the outlet communicate with one of the plurality of air outlets of the base member; and removably attaching a shell to the base member to form an internal chamber, wherein the inlet of each self-contained tubular runner communicates with the internal chamber.

24. The method of assembling an intake manifold of claim 23, further comprising:

attaching each self-contained tubular runner to the base member with a fastener, wherein the shell is formed so as to retain the fastener between the shell and the base member when the shell is attached to the base member.

25. The method of assembling an intake manifold of claim 23, further comprising:

aligning a sealing ridge extending from a surface of the shell with a sealing groove provided in a surface of the base member to retain a sealing material there between when the shell is attached to the base member.

26. The method of assembling an intake manifold of claim 23, further comprising:

affixing a bumper to a surface of the base member so that the bumper abuts a surface of the internal combustion engine when the base member is attached to the internal combustion engine.

27. The modular intake manifold assembly of claim 9, wherein:

the bumper is supported by a compressed top portion of a valley cover of the internal combustion engine; and the compressed valley cover enlarges a plenum of the intake manifold assembly.

28. The modular intake manifold assembly of claim 20, wherein:

the bumper is supported by a compressed top portion of a valley cover of the internal combustion engine; and the compressed valley cover enlarges a plenum of the intake manifold assembly.

29. The method of assembling an intake manifold of claim 26, wherein:

the bumper is supported by a compressed top portion of a valley cover of the internal combustion engine; and the compressed valley cover enlarges a plenum of the intake manifold assembly.

* * * * *